US009834021B2

(12) United States Patent
Hattori

(10) Patent No.: US 9,834,021 B2
(45) Date of Patent: Dec. 5, 2017

(54) PRINTING APPARATUS AND CONTROL METHOD THEREOF

(71) Applicant: FUJIFILM Corporation, Tokyo (JP)

(72) Inventor: Kazumasa Hattori, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/456,579

(22) Filed: Mar. 13, 2017

(65) Prior Publication Data

US 2017/0267005 A1 Sep. 21, 2017

(30) Foreign Application Priority Data

Mar. 15, 2016 (JP) ..... 2016-051284

(51) Int. Cl.
*B41J 29/393* (2006.01)
*B41J 2/21* (2006.01)
*B41J 2/045* (2006.01)

(52) U.S. Cl.
CPC ..... *B41J 29/393* (2013.01); *B41J 2/0451* (2013.01); *B41J 2/04558* (2013.01); *B41J 2/2132* (2013.01); *B41J 2/2135* (2013.01); *B41J 2/2142* (2013.01)

(58) Field of Classification Search
CPC .... B41J 29/393; B41J 2/0451; B41J 2/04558; B41J 2/2132; B41J 2/2135; B41J 2/2142
See application file for complete search history.

(56) References Cited

U.S. PATENT DOCUMENTS

2006/0092211 A1* 5/2006 Arakawa ..... B41J 2/16579 347/19
2009/0244164 A1* 10/2009 Nakamaki ..... B41J 2/16579 347/19
2013/0162712 A1* 6/2013 Yamanobe ..... B41J 11/002 347/16
2016/0144643 A1 5/2016 Igarashi et al.

FOREIGN PATENT DOCUMENTS

JP H09-240120 9/1997
JP 2002-059606 2/2002
JP 2015-030183 2/2015

* cited by examiner

*Primary Examiner* — Julian Huffman
(74) *Attorney, Agent, or Firm* — JCIPRNET

(57) ABSTRACT

A control method for a printing apparatus includes: an image defect detecting step of detecting an ejection curve amount of a nozzle in an inkjet head and an image defect from a recordable medium on a surface of which an image is recorded by an image recording part provided with the inkjet head having a plurality of nozzles, and a stamp step of attaching a stamp indicating presence of the image defect on the recordable medium by a stamping device in a case where the image defect is detected, the stamp step differentiating an attachment form of the stamp by the stamping device in accordance with a magnitude of the ejection curve amount of the nozzle.

12 Claims, 11 Drawing Sheets

PRINTING APPARATUS AND CONTROL METHOD THEREOF

CROSS-REFERENCE TO RELATED APPLICATIONS

The present application claims priority under 35 U.S.C. §119 to Japanese Patent Application No. 2016-051284, filed on Mar. 15, 2016. The above application is hereby expressly incorporated by reference, in its entirety, into the present application.

BACKGROUND OF THE INVENTION

Field of the Invention

The presently disclosed subject matter relates to a printing apparatus, and a control method for the printing apparatus, and particularly, to a printing apparatus for detecting a print defect from a recordable medium (print sheet) after printing, and a control method for the printing apparatus.

Description of the Related Art

It is proposed that in a case where a defect is detected from a recordable medium (print sheet) on which an image and the like are printed by a printing apparatus, a stamp and the like are applied on a printed matter in which the defect is detected.

Japanese Patent Application Laid-Open No. 2015-030183 discloses an inkjet printing apparatus provided with a first stamping device and a second stamping device. The first stamping device causes ink to adhere to a tip end edge of a paper sheet on which an image defect is determined to occur based upon a readout result of an inline sensor 58, and the second stamping device causes ink to adhere to a tip end edge of a paper sheet corresponding to a sorting section, based upon the preset sorting sheet number (paragraphs [0140] to [0142] in Japanese Patent Application Laid-Open No. 2015-030183).

Japanese Patent Application Laid-Open No. 2002-059606 discloses an inkjet printing apparatus provided with a backside mark applying device that applies "a backside mark" clearly specifying a mistake printing surface automatically in a case of performing a necessary print on an opposite surface to a paper sheet mistakenly printed (paragraphs [0002] to [0004], [0028] and [0032] in Japanese Patent Application Laid-Open No. 2002-059606).

Japanese Patent Application Laid-Open No. 9-240120 discloses a printing system provided with a printing part (a front printing portion and a back printing portion) having an inspection part and a defect print marking part. The inspection part determines whether or not a printing state is appropriate based upon print image data and inspection image data (paragraphs [0015] and [0033] in Japanese Patent Application Laid-Open No. 9-240120). The defect print marking part has a print head for painting-out in which in a case where it is determined in the inspection part that a print result illustrates a defect printed matter, a content already printed in a predetermined region of the printed matter is painted out to be unidentifiable, and the printed matter is recognized as a detective at first glance, preventing the printed matter from being used as an original printed matter any longer (paragraphs [0045] and [0046] in Japanese Patent Application Laid-Open No. 9-240120).

SUMMARY OF THE INVENTION

In Japanese Patent Application Laid-Open No. 2015-030183, it is only one kind of a stamp that is attached (imprinted) on a print sheet in a case where the defect is detected. Therefore in a case where an operator sorts out the print sheets by inspecting the extent of the defect of the print sheet after imprinting the stamp on the print sheet, the operator can only confirm presence/absence of the detection of the defect by presence/absence of the stamp. In this case, as detection sensibility of the defect is set the higher, the sheet number of the print sheets on which the stamp is imprinted becomes larger. As a result, there is a problem that loads of an inspection work by an operator increase. As the detection sensibility of the defect is set the lower, the sheet number of the print sheets on which the stamp is imprinted becomes smaller. As a result, a slight defect is overlooked and the print sheet having the defect is not detected appropriately, creating a possibility that the defect print sheet flows out into end users.

The art described in Japanese Patent Application Laid-Open No. 2002-059606 is configured to attach a backside mark on a mistake printing surface in a case of reuse of a so-called backing sheet, but is not designed to support a sorting work of defect print sheets by an operator.

The art described in Japanese Patent Application Laid-Open No. 9-240120 is designed to, in a case of an invoice or the like with an address, paint out an address part or in a case of a security or a cash voucher, paint out a money amount part thereof, resulting in recognition of being unusable, but is not designed to support a sorting work of defect print sheets by an operator.

The presently disclosed subject matter is made in view of such a circumference, and an object of the presently disclosed subject matter is to provide a printing apparatus for supporting a sorting work of recordable media (print sheets) in which a print defect is detected, and a control method for the printing apparatus.

In order to solve the above problems, a printing apparatus according to a first aspect of the presently disclosed subject matter includes: an image recording part including an inkjet head that ejects inks from a plurality of nozzles to record an image on a surface of a recordable medium, an image defect detecting part that detects an ejection curve amount of a nozzle in the inkjet head and an image defect from the recordable medium on the surface of which the image is recorded, a stamping device that attaches a stamp indicating presence of the image defect on the recordable medium in a case where the image defect is detected, and a stamp control part that differentiates an attachment form of the stamp by the stamping device in accordance with a magnitude of the ejection curve amount of the nozzle.

According to the first aspect, in a case where the image defect (streak) due to the nozzle is detected, it is possible to change the kind of the stamp in accordance with the extent of the streak. Thereby since an operator can recognize the extent of the streak from the stamp, the present embodiment can support an inspection work by the operator and realize efficiency of the inspection work.

The printing apparatus according to a second aspect of the presently disclosed subject matter may be configured such that in the first aspect, the image defect detecting part performs detection of the image defect for each of colors of inks and differentiates a threshold of the ejection curve amount of the nozzle to be detected as the image defect.

According to the second aspect, it is possible to appropriately perform the detection of the image defect by adjusting the threshold in consideration of a difference in visibility of the image defect for each of the colors of the inks.

The printing apparatus according to a third aspect of the presently disclosed subject matter may be configured such that in the first or second aspect, the inkjet head ejects at least a black ink, the image defect detecting part performs detection of the image defect for each of the colors of the inks, and performs detection of the image defect by the black ink is performed prior to detection of the image defect by the ink of the color other than black.

The printing apparatus according to a fourth aspect of the presently disclosed subject matter may be configured such that in any one of the first aspect to the third aspect, the inkjet head ejects at least a black ink, the image defect detecting part performs detection of the image defect for each of the colors of the inks, and makes a threshold of an ejection curve amount of a nozzle to be used for detection of an image defect in regard to the black ink smaller than a threshold of an ejection curve amount of a nozzle to be used for detection of an image defect in regard to the ink of the color other than black.

According to the fourth aspect, t is possible to perform the strict detection of the image defect in regard to the black ink having a relatively high visibility to the streak. It is possible not to perform detection of the curve of the nozzle in regard to the ink having a relatively low visibility to the streak.

The printing apparatus according to a fifth aspect of the presently disclosed subject matter may be configured such that in the third or fourth aspect, the inkjet head ejects a yellow ink, and the image defect detecting part makes a threshold of an ejection curve amount of a nozzle to be used for detection of an image defect in regard to the yellow ink larger than a threshold of an ejection curve amount of a nozzle to be used for detection of an image defect in regard to the ink of the color other than yellow.

According to the fifth aspect, it is possible to reduce accuracy in detection of the image defect in regard to the yellow ink having a relatively low visibility to the streak.

The printing apparatus according to a sixth aspect of the presently disclosed subject matter may be configured such that in any one of the first aspect to the fifth aspect, the stamp control part differentiates at least one of colors, numbers and positions of the stamp attached by the stamping device in accordance with the ejection curve amount of the nozzle.

The printing apparatus according to a seventh aspect of the presently disclosed subject matter may be configured such that in the sixth aspect, the stamping device includes a plurality of stamping devices to attach a plurality of kinds of stamps differing in at least one of colors, numbers and positions of the stamp.

The printing apparatus according to an eighth aspect of the presently disclosed subject matter may be configured such that in the sixth aspect, the stamping device includes a plurality of stamping devices to attach a plurality of kinds of stamps differing in accordance with the ejection curve amount of the nozzle for each of the colors of the inks of the inkjet head.

The printing apparatus according to a ninth aspect of the presently disclosed subject matter may further include an operating part configured to set an attachment condition of the stamp upon reception of operating input of an operator in any one of the first aspect to the eighth aspect.

The printing apparatus according to a tenth aspect of the presently disclosed subject matter may be configured to discharge the recordable medium to a different place in accordance with a magnitude of the ejection curve amount of the nozzle in any one of the first aspect to the ninth aspect.

A control method for a printing apparatus according to an eleventh aspect of the presently disclosed subject matter includes an image defect detecting step of detecting an ejection curve amount of a nozzle in an inkjet head and an image defect from a recordable medium on a surface of which an image is recorded by an image recording part provided with the inkjet head having a plurality of nozzles, and a stamp step of attaching a stamp indicating presence of the image defect on the recordable medium by a stamping device in a case where the image defect is detected, the stamp step differentiating an attachment form of the stamp by the stamping device in accordance with a magnitude of the ejection curve amount of the nozzle.

A non-transitory computer-readable recording medium according to a twelfth aspect of the presently disclosed subject matter includes a control program for a printing apparatus stored thereon, such that when the program is read and executed by a computer, the computer is configured to achieve: an image defect detecting function for detecting an ejection curve amount of a nozzle in an inkjet head and an image defect from a recordable medium on a surface of which an image is recorded by an image recording part provided with the inkjet head having a plurality of nozzles, and a stamp function for attaching a stamp indicating presence of the image defect on the recordable medium by a stamping device in a case where the image defect is detected, the stamp function differentiating an attachment form of the stamp by the stamping device in accordance with a magnitude of the ejection curve amount of the nozzle, wherein the image defect detecting function and the stamp function are realized by a computer.

According to the presently disclosed subject matter, in a case where the image defect (streak) due to the nozzle is detected, it is possible to change the kind of the stamp in accordance with the extent of the streak. Thereby since an operator can recognize the extent of the streak from the stamp, it is possible to support the inspection work by the operator and realize the efficiency of the inspection work.

DETAILED DESCRIPTION OF THE EMBODIMENTS

Hereinafter, embodiments of a printing apparatus, and a control method for the printing apparatus according to the presently disclosed subject matter will be described with reference to the accompanying drawings. In the present embodiments, an explanation will be made of an example where a condensation treatment liquid is used and a water-based pigment ink is used, but the presently disclosed subject matter may be applied also to a case where the condensation treatment liquid is not used and a case where an oil-based ink is used.

<<Apparatus Configuration>>

Figure 1:
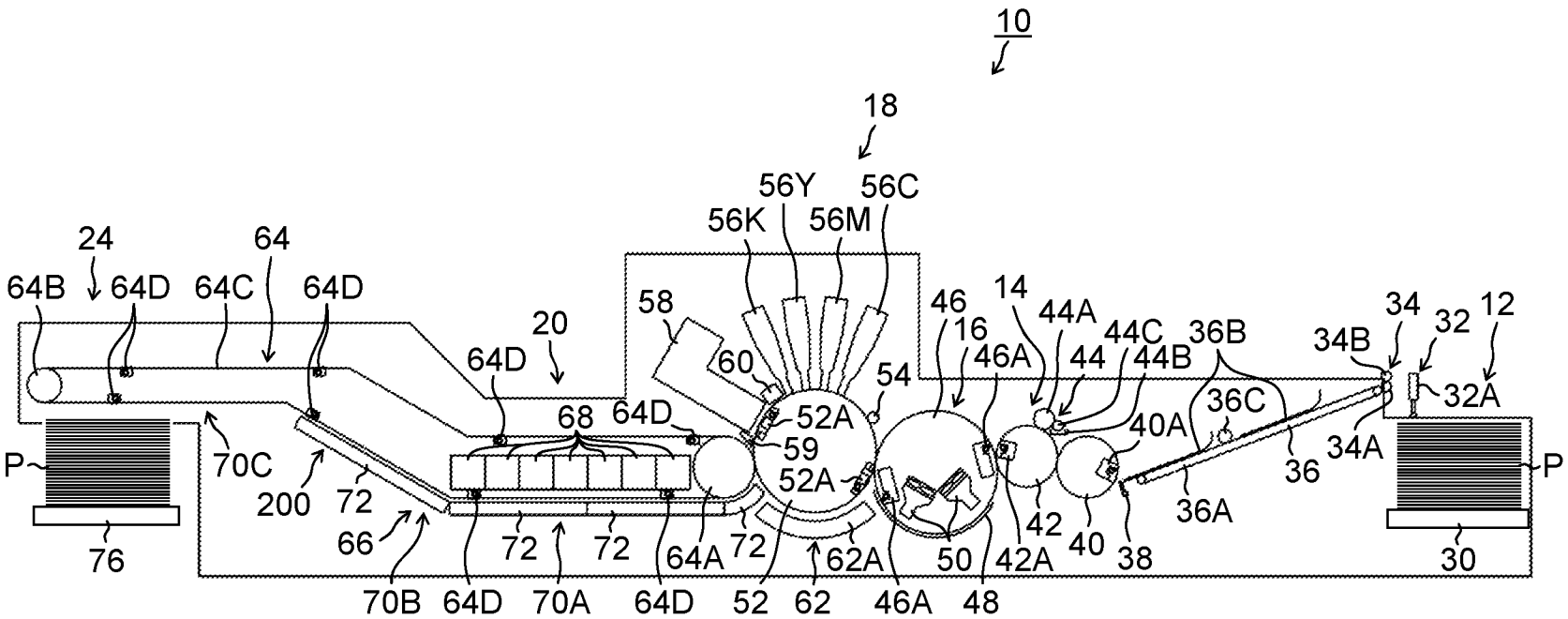
FIG. 1 is an entire configuration diagram illustrating an embodiment of an inkjet recording device according to the presently disclosed subject matter.

FIG. 1 is an entire configuration diagram illustrating an embodiment of an inkjet recording device according to the presently disclosed subject matter.

An inkjet recording device 10 according to the present embodiment records an image on a paper sheet (recordable medium) P of a sheet in an inkjet method using a water-based pigment ink (ink in which coloring pigment is distributed in an aqueous solvent). As illustrated in FIG. 1, the inkjet recording device 10 includes a sheet feeding part 12 that feeds paper sheets P, a treatment liquid applying part 14 that applies a predetermined treatment liquid on a surface (image recording surface) of the paper sheet P fed from the sheet feeding part 12, a treatment liquid drying processing part 16 that performs drying processing of the paper sheet P on which the treatment liquid is applied in the treatment liquid applying part 14, an image recording part 18 that records an image on a surface of the paper sheet P subjected to the drying processing in the treatment liquid drying processing part 16 by an inkjet method using the water-based pigment ink, an ink drying processing part 20 that performs drying processing of the paper sheet P on which the image is recorded in the image recording part 18, a stamping processing part 200 that attaches ink to the paper sheet P, and a sheet discharging part 24 on which the paper sheets P discharged after completion of all the processing are stacked.

Conveyance of the paper sheets P from the sheet feeding part 12 to the sheet discharging part 24 is carried out by a conveyance part configured of a drum type conveyance device and a chain gripper type conveyance device as explained as follows.

<Sheet Feeding Part>

The sheet feeding part 12 feeds paper sheets P stacked on a sheet feeding platform 30 to the treatment liquid applying part 14 one by one. The sheet feeding part 12 includes the sheet feeding platform 30, a sucker device 32, a pair of sheet feeding rollers 34, a feeder board 36, a front guide 38, and a sheet feeding drum 40.

The paper sheets P are placed on the sheet feeding platform 30 in a bunch state where multiple paper sheets are stacked. The sheet feeding platform 30 is provided to be capable of elevating by a sheet-feeding platform elevating device that is not illustrated. The sheet-feeding platform elevating device is controlled in driving in association with an increase/decrease of the paper sheets P stacked on the sheet feeding platform 30 and causes the sheet-feeding platform 30 to go up and down in such a manner that the paper sheet P positioned in the top of the bunch is always positioned in a constant height.

The paper sheet P as a recordable medium is not particularly limited, but can use a general print sheet (paper sheet having cellulose as a major element such as so-called high-quality paper, coated paper and art paper) to be used in general offset printing. In the present example, the coated paper is used. The coated paper is provided with a coated layer by applying a coating material on a surface of a high-quality paper, an alkaline paper or the like that is generally not subjected to surface treatment. Specifically an art paper, a coated paper, a light-weight coated paper, a finely coated paper and the like are preferably used.

The sucker device 32 picks up the paper sheets P stacked on the sheet feeding platform 30 from the top thereof one by one to be fed to the pair of the sheet feeding rollers 34. The sucker device 32 includes a suction fit 32A provided to be capable of elevating and swinging, and this suction fit 32A absorbs and holds an upper surface of the paper sheet P and conveys the paper sheet P from the sheet feeding platform 30 to the pair of the sheet feeding rollers 34. At this time, this suction fit 32A absorbs and holds an upper surface on a tip end side of the paper sheet P positioned in the top in the bunch, pulls up the paper sheet P and inserts a tip end of the pulled-up paper sheet P in between a pair of rollers 34A, 34B configuring the pair of the sheet feeding rollers 34.

The pair of the sheet feeding rollers 34 includes the pair of the up and down rollers 34A, 34B pressed and contacted with each other. One of the pair of the up and down rollers 34A, 34B works as a driving roller (roller 34A) and the other works as a driven roller (roller 34B), and the driving roller (roller 34A) is driven by a motor for rotation that is not illustrated. The motor is driven in association with sheet feeding of the paper sheet P, and when the paper sheet P is fed from the sucker device 32, the driving roller (roller 34A) is rotated in synchronization with the timing. The paper sheet P inserted in between the pair of the up and down rollers 34A, 34B is nipped by the rollers 34A, 34B to be fed in a rotating direction (mounting direction of a feeder board 36) of the rollers 34A, 34B.

The feeder board 36 is formed corresponding to a sheet width and receives the paper sheet P fed from the pair of the sheet feeding rollers 34, and guides the paper sheet P to the front guide 38. The feeder board 36 is mounted with a tip end side thereof being inclined downward, and causes the paper sheet P placed on the conveyance surface to smoothly slide on the conveyance surface to be guided to the front guide 38.

A plurality of tape feeders 36A for conveying the paper sheet P are mounted on the feeder board 36 by intervals in a width direction. The tape feeder 36A is formed in an endless shape and is driven by a motor to be rotated that is not illustrated. The paper sheet P placed on the conveyance surface of the feeder board 36 is conveyed on the feeder board 36 by the tape feeder 36A.

Retainers 36B and a roller 36C are mounted on the feeder board 36.

The retainer 36B includes a plurality of retainers arranged tandemly backward and forward along the conveyance surface of the paper sheet P (two retainers in this example). The retainer 36B includes a plate spring having a width corresponding to the sheet width, and the plate spring is pressed and abuts on the conveyance surface of the feeder board 36. The paper sheet P conveyed on the feeder board 36 by the tape feeder 36A passes the retainer 36B to correct concavity and convexity. The retainers 36B have, for easy introduction of the paper sheet P in between the feeder board 36 and the retainer 36B, rear end portions curled at the opposite side to the conveyance surface of the feeder board 36.

The roller 36C is arranged between before and after the retainers 36B. The roller 36C is mounted to be pressed and abut on the conveyance surface of the paper sheet P. The paper sheet P to be conveyed between before and after the retainers 36B is conveyed while the upper face is pressed by the roller 36C.

The front guide 38 corrects an orientation of the paper sheet P. The front guide 38 is formed in a plate shape, and is arranged perpendicular to a conveyance direction of the paper sheet P. In addition, the front guide 38 is driven by a motor that is not illustrated and is provided to be capable of swinging. The paper sheet P conveyed on the feeder board 36 abuts on the front guide 38 in the tip end to correct the orientation (what is called skew prevention). The front guide 38 swings in association with the sheet feeding of the paper sheet to the sheet feeding drum 40, and delivers the paper sheet P the orientation of which is corrected to the sheet feeding drum 40.

The sheet feeding drum 40 receives the paper sheet P fed from the feeder board 36 through the front guide 38 to be conveyed to the treatment liquid applying part 14. The sheet feeding drum 40 is formed in a cylindrical shape, and is driven by a motor to be rotated that is not illustrated. A gripper 40A is provided on an outer peripheral surface of the sheet feeding drum 40, and a tip end of the paper sheet P is gripped by the gripper 40A. The sheet feeding drum 40 rotates by gripping the tip end of the paper sheet P by the gripper 40A, and thereby conveys the paper sheet P to the treatment liquid applying part 14 while winding the paper sheet P around the peripheral surface.

The sheet feeding part 12 is configured as described above. With this configuration, the paper sheets P stacked on the sheet feeding platform 30 are picked up one by one in order from above by the sucker device 32, and are fed to the pair of the sheet feeding rollers 34. The paper sheet P fed to the pair of the sheet feeding rollers 34 are fed forward by the pair of the up and down rollers 34A, 34B configuring the pair of the sheet feeding rollers 34, and are placed on the feeder board 36. The paper sheet P placed on the feeder board 36 is conveyed by the tape feeder 36A provided on the conveyance surface of the feeder board 36. The paper sheet P is pressed on the conveyance surface of the feeder board 36 by the retainer 36B in the conveyance process to correct the concavity and convexity. The paper sheet P conveyed by the feeder board 36 abuts on the front guide 38 in the tip end, and thereby an inclination of the paper sheet P is corrected, and thereafter the paper sheet is delivered to the sheet feeding drum 40. In addition, the paper sheet P is conveyed to the treatment liquid applying part 14 by the sheet feeding drum 40.

<Treatment Liquid Applying Part>

The treatment liquid applying part 14 applies a predetermined treatment liquid on a surface (image recording surface) of the paper sheet P. The treatment liquid applying part 14 includes a treatment liquid applying drum 42 that conveys paper sheets P and a treatment liquid applying unit 44 that applies the predetermined treatment liquid on the printing surface of the paper sheet P conveyed by the treatment liquid applying drum 42.

The treatment liquid applying drum 42 receives the paper sheet P from the sheet feeding drum 40 in the sheet feeding part 12 and conveys the paper sheer P to the treatment liquid drying processing part 16. The treatment liquid applying drum 42 is formed in a cylindrical shape, and is driven/rotated by a motor that is not illustrated. A gripper 42A is provided on an outer peripheral surface of the treatment liquid applying drum 42, and a tip end of the paper sheet P is gripped by the gripper 42A. The treatment liquid applying drum 42 rotates by gripping the tip end of the paper sheet P by the gripper 42A, and thereby conveys the paper sheet P to the treatment liquid drying processing part 16 while winding the paper sheet P around the peripheral surface (conveys one paper sheet P with one rotation). The treatment liquid applying drum 42 and the sheet feeding drum 40 are controlled in rotation such that reception of one paper sheet P and delivery of the other paper sheet P are timed to each other. That is, the treatment liquid applying drum 42 and the sheet feeding drum 40 are driven in such a manner as to have the same peripheral speed, and are driven such that positions of the grippers are in agreement with each other.

The treatment liquid applying unit 44 roller-applies a treatment liquid on the surface of the paper sheet P conveyed by the treatment liquid applying drum 42. The treatment liquid applying unit 44 includes an application roller 44A that applies a treatment liquid on the paper sheet P, a treatment liquid reservoir 44B in which a treatment liquid is reserved, and a drawing roller 44C that draws up a treatment liquid reserved in the treatment liquid reservoir 44B to be supplied to the application roller 44A. The drawing roller 44C is mounted to be pressed and abut on the application roller 44A, and a part of the drawing roller 44C is immersed in the treatment liquid reserved in the treatment liquid reservoir 44B. The drawing roller 44C meters a treatment liquid to be drawn up, and applies the treatment liquid in a constant thickness on the peripheral surface of the application roller 44A. The application roller 44A is provided to correspond to a sheet width, and is pressed and abuts on the paper sheet P to apply the treatment liquid applied on the peripheral surface on the paper sheet P. The application roller 44A is driven by a contact-separation mechanism that is not illustrated and moves between an abutting position of abutting on the peripheral surface of the treatment liquid applying drum 42 and a separation position of being separated from the peripheral surface of the treatment liquid applying drum 42. The contact-separation mechanism moves the application roller 44A in response to a passing timing of the paper sheet P, and the treatment liquid is applied on the surface of the paper sheet P conveyed by the treatment liquid applying drum 42.

In the present example, the treatment liquid is designed to be roller-applied, but a method of applying the treatment liquid is not limited thereto. In addition to or instead of the above roller-applying method, the configuration of using the inkjet head for application or using a spray for application may be adopted.

The treatment liquid applying part 14 is configured as described above. With this configuration, the paper sheet P delivered from the sheet feeding drum 40 in the sheet feeding part 12 is received by the treatment liquid applying drum 42. The treatment liquid applying drum 42 rotates by gripping the tip end of the paper sheet P by the gripper 42A, and thereby winds the paper sheet P around the peripheral surface for conveyance. In this conveyance process, the application roller 44A is pressed and abuts on the surface of the paper sheet P to apply the treatment liquid on the surface of the paper sheet P.

Here, as the treatment liquid applied on the surface of the paper sheet P, a treatment liquid having a function of causing color materials in a water-based pigment ink struck in the form of droplets on the paper sheet P in the image recording part 18 in the subsequent stage to be condensed is applied. This treatment liquid is applied on the surface of the paper sheet P to strike droplets of the water-based pigment ink thereon, and thereby even in a case of using a general print sheet, it is possible to perform a high-grade print without causing impact interference of droplets or the like.

<Treatment liquid Drying Processing Part>

The treatment liquid drying processing part 16 performs drying processing to the paper sheet P on a surface of which the treatment liquid is applied. The treatment liquid drying processing part 16 includes a treatment liquid drying processing drum 46 that conveys the paper sheet P, a sheet conveying guide 48, and a treatment liquid drying processing unit 50 that blows heated air on a printing surface of the paper sheet P conveyed by the treatment liquid drying processing drum 46 to dry the paper sheet P.

The treatment liquid drying processing drum 46 receives the paper sheet P from the treatment liquid applying drum 42 in the treatment liquid applying part 14, and conveys the paper sheet P to the image recording part 18. The treatment liquid drying processing drum 46 is formed in a frame body assembled in a cylindrical shape, and is driven by a motor to be rotated that is not illustrated. A gripper 46A is provided on an outer peripheral surface of the treatment liquid drying processing drum 46, and a tip end of the paper sheet P is gripped by the gripper 46A. The treatment liquid drying processing drum 46 grips the tip end of the paper sheet P by the gripper 46A and rotates, and thereby conveys the paper sheet P to the image recording part 18.

The treatment liquid drying processing drum 46 in the present example is provided with grippers 42A arranged in two locations on the outer peripheral surface, and is configured to be capable of conveying two paper sheets P by rotation of one time. The treatment liquid drying processing drum 46 and the treatment liquid applying drum 42 are controlled in rotation such that reception of one paper sheet P and delivery of the other paper sheet P are timed to each other. That is, the treatment liquid drying processing drum 46 and the treatment liquid applying drum 42 are driven in such a manner as to have the same peripheral speed, and are driven such that positions of the grippers 42A are in agreement with each other.

A sheet conveying guide 48 is arranged along the conveyance path of the paper sheet P by the treatment liquid drying processing drum 46, and guides the conveyance of the paper sheet P.

The treatment liquid drying processing units 50 are arranged inside the treatment liquid drying processing drum 46, and blow air heated to more than an environment temperature (heated air) on a surface of the paper sheet P conveyed by the treatment liquid drying processing drum 46 to perform the drying processing. In this example, the two treatment liquid drying processing units 50 are arranged inside the treatment liquid drying processing drum 46, and blow the heated air on the surface of the paper sheet P conveyed by the treatment liquid drying processing drum 46.

The treatment liquid drying processing part 16 is configured as described above. With this configuration, the paper sheet P delivered from the treatment liquid applying drum 42 in the treatment liquid applying part 14 is received in the treatment liquid drying processing drum 46. The treatment liquid drying processing drum 46 grips the tip end of the paper sheet P by the gripper 46A and rotates, and thereby conveys the paper sheet P. At this time, the treatment liquid drying processing drum 46 conveys the paper sheet P directing the surface (surface on which the treatment liquid is applied) of the paper sheet P to the inside. In the process where the paper sheet P is conveyed by the treatment liquid drying processing drum 46, the heated air is blown on the surface from the treatment liquid drying processing unit 50 mounted inside the treatment liquid drying processing drum 46 to perform the drying processing. Thereby solvent components in the treatment liquid are removed to form an ink condensation layer on the surface of the paper sheet P.

<Image Recording Part>

The image recording part 18 strikes droplets of inks (water-based pigment inks) of the respective colors of C (cyan), M (magenta), Y (yellow) and K (black (key plate)) on the printing surface of the paper sheet P to draw a colored image on the printing surface of the paper sheet P. The image recording part 18 includes an image recording drum 52 for conveying the paper sheet P, a sheet pressing roller 54 that presses the paper sheet P conveyed by the image recording drum 52 to cause the paper sheet P to come into close contact with the peripheral surface of the image recording drum 52, inkjet heads 56C, 56M, 56Y and 56K that eject ink droplets of the respective colors of C, M, Y, K on the paper sheet P, an inline sensor 58 for reading in an image recorded on the paper sheet p, a mist filter 60 for trapping ink mists, and a drum cooling unit 62.

The image recording drum 52 receives the paper sheet P from the treatment liquid drying processing drum 46 in the treatment liquid drying processing part 16, and conveys the paper sheet P to the ink drying processing part 20. The image recording drum 52 is formed in a cylindrical shape, and is driven by a motor to be rotated that is not illustrated. A gripper 52A is provided on an outer peripheral surface of the image recording drum 52, and a tip end of the paper sheet P is gripped by the gripper 52A. The image recording drum 52 grips the tip end of the paper sheet P by the gripper 52A and rotates, and thereby conveys the paper sheet P to the ink drying processing part 20 while winding the paper sheet P around the peripheral surface. The image recording drum 52 is provided with multiple suction holes (not illustrated) formed in a given pattern on the peripheral surface. The paper sheet P wound around the peripheral surface of the image recording drum 52 is sucked through the suction holes, and thereby is conveyed while being absorbed and held onto the peripheral surface of the image recording drum 52. As a result, the paper sheet P can be conveyed with high flatness.

The suction through the suction holes works only in a constant range, and works between a predetermined suction start position and a predetermined suction end position. The suction start position is set to a mounting position of the sheet pressing roller 54, and the suction end position is set in the downstream side of the mounting position of the inline sensor 58 (for example, is set to a position of delivering the paper sheet to the ink drying processing part 20). That is, at least at mounting positions (image recording positions) of the inkjet heads 56C, 56M, 56Y and 56K and a mounting position (image reading position) of the inline sensor 58, the paper sheet P is set such that the paper sheet P is to be absorbed and held on the peripheral surface of the image recording drum 52.

The mechanism for causing the paper sheet P to be absorbed and held on the peripheral surface of the image recording drum 52 is not limited to the absorption method by the above vacuum, but may adopt a method by an electrostatic absorption.

The image recording drum 52 in this example is provided with grippers 52A arranged in two locations on the outer peripheral surface, and is configured to be capable of conveying two paper sheets P by rotation of one time. The image recording drum 52 and the treatment liquid drying processing drum 46 are controlled in rotation such that reception of one paper sheet P and delivery of the other paper sheet P are timed to each other. That is, the image recording drum 52 and the treatment liquid drying processing drum 46 are driven in such a manner as to have the same peripheral speed, and are driven such that positions of the grippers 52A of each other are in agreement.

The sheet pressing roller 54 is arranged in the vicinity of a sheet receiving position of the image recording drum 52 (position of receiving the paper sheet P from the treatment liquid drying processing drum 46). The sheet pressing roller 54 is formed of a rubber roller, and is mounted to be pressed and abut on the peripheral surface of the image recording drum 52. The paper sheet P delivered to the image recording drum 52 from the treatment liquid drying processing drum 46 passes the sheet pressing roller 54 to be nipped and is brought into close contact with the peripheral surface of the image recording drum 52.

Four inkjet heads 56C, 56M, 56Y and 56K are arranged by constant intervals along the conveyance path of the paper sheet P by the image recording drum 52. The inkjet heads 56C, 56M, 56Y and 56K are configured with line heads corresponding to a sheet width, and a nozzle surface thereof is arranged to face the peripheral surface of the image recording drum 52. The inkjet heads 56C, 56M, 56Y and 56K each eject droplets of inks toward the image recording drum 52 from a nozzle array formed on the nozzle surface, and thereby an image is recorded on the paper sheet P conveyed by the image recording drum 52.

As described above, a water-based pigment ink is used as the ink ejected from each of the inkjet heads 56C, 56M, 56Y and 56K. By causing the water-based pigment ink to condensation-react with the treatment liquid applied by the treatment liquid applying part 14, it is possible to condense coloring pigment in the water-based pigment ink.

The inline sensor 58 is mounted downstream of the rear-most inkjet head 56K to the conveyance direction of the paper sheet P by the image recording drum 52, and reads out an image recorded by the inkjet heads 56C, 56M, 56Y and 56K. The inline sensor 58 is configured with, for example, a line scanner, and reads out the image recorded by the inkjet heads 56C, 56M, 56Y and 56K from the paper sheet P conveyed by the image recording drum 52.

An image defect is detected based upon the imaging pickup result of the inline sensor 58 by an image defect detecting part (not illustrated in FIG. 1 and illustrated by reference numeral 136 in FIG. 4). "Image defect" herein is assumed to be a defect due to ejection abnormality of each of the inkjet heads 56C, 56M, 56Y and 56K, for example, a streak due to ejection curve of the ink from the inkjet head. Further, an example of the image defect may include defects due to color deviation and adherence of foreign objects such as ink mists and the like.

The image defect may include abnormality on the paper sheet P recognizable from the imaging pickup result of the inline sensor 58, and is not limited to the above listed. Along with the inline sensor 58 or instead of the inline sensor 58, a sensor (dirt detecting part) for detecting a dirt of the paper sheet P or the like may be independently prepared.

The present example exemplifies the form of using the imaging pickup result of the inline sensor 58 configured with the line scanner as a defect detecting device, but the presently disclosed subject matter is not limited thereto, but the other configurations and methods may be applied to the defect detecting part and the dirt detecting part.

For example, in addition to the inline sensor 58, the form of being provided with an imaging pickup device (high-speed camera) that directly images an ejection state of inks of the inkjet heads 56C, 56M, 56Y and 56K is made possible.

A contact prevention plate 59 is placed close to the inline sensor 58 downstream of the inline sensor 58. The contact prevention plate 59 prevents the paper sheet P from coining into contact with the inline sensor 58 in a case where the paper sheet P floats due to a defect of the conveyance or the like.

A mist filter 60 is arranged between the inkjet head 56K in the rear-most tail and the inline sensor 58 and sucks air in the circumference of the image recording drum 52 to trap ink mists. In this way, by sucking the air in the circumference of the image recording drum 52 to trap the ink mist, it is possible to prevent the entry of the ink mist into the inline sensor 58, preventing occurrence of the readout defect or the like.

A drum cooling unit 62 blows air (cooling air) adjusted in temperature on the image recording drum 52 to cool the image recording drum 52. The image cooling unit 62 includes an air conditioner (not illustrated) and a duct 62A for blowing cooling air supplied from the air conditioner on the peripheral surface of the image recording drum 52. The duct 62A blows the cooling air on the image recording drum 52 in a region other than the conveyance region of the paper sheet P to cool the image recording drum 52. In this example, since the paper sheet P is conveyed along an arc surface of the substantially upper half of the image recording drum 52, the duct 62A blows cooling air on the region of the substantially lower half of the image recording drum 52 to cool the image recording drum 52. Specifically a blowout port of the duct 62A is formed in an arc shape to cover the substantially lower half of the image recording drum 52 to blow the cooling air on the region of the substantially lower half of the image recording drum 52.

Here, a temperature of cooling the image recording drum 52 is defined by a relationship to temperatures of the inkjet heads 56C, 56M, 56Y and 56K (particularly a temperature of the nozzle surface), and the image recording drum 52 is cooled to have a temperature lower than the temperature of each of the inkjet heads 56C, 56M, 56Y and 56K. This can prevent dew condensation from being generated in the inkjet heads 56C, 56M, 56Y and 56K. That is, by lowering the temperature of the image recording drum 52 to a temperature lower than that of the inkjet heads 56C, 56M, 56Y and 56K, it is possible to induce the dew condensation on the image recording drum side and prevent the dew condensation (particularly the dew condensation to be generated on the nozzle surface) from being generated in the inkjet heads 56C, 56M, 56Y and 56K.

The image recording part 18 is configured as described above. With this configuration, the paper sheet P delivered from the treatment liquid drying processing drum 46 in the treatment liquid drying processing part 16 is received in the image recording drum 52. The image recording drum 52 grips the tip end of the paper sheet P by the gripper 52A and rotates, and thereby conveys the paper sheet P. The paper sheet P delivered in the image recording drum 52 passes through the sheet pressing roller 54 to be brought into close contact with the peripheral surface of the image recording drum 52. Simultaneously with this, the paper sheet P is sucked through the absorption holes of the image recording drum 52 to be absorbed and held on the outer peripheral surface of the image recording drum 52. The paper sheet P is conveyed in this state, and passes through the respective inkjet heads 56C, 56M, 56Y and 56K. At the passing time, droplets of inks of the respective colors of C, M, Y and K from the respective inkjet heads 56C, 56M, 56Y and 56K are struck in the form of droplets on the surface to draw a colored image on the surface. Since the ink condensation layer is formed on the surface of the paper sheet P, it is possible to record a high-grade image without causing feathering, bleeding and the like.

The paper sheet P on which the image is recorded by the inkjet heads 56C, 56M, 56Y and 56K next passes through the inline sensor 58. The image recorded on the surface is read out at the passing time of the inline sensor 58. The readout of the recorded image is performed in regard to all the paper sheets P. At the readout time, since the readout is performed in a state where the paper sheet P is absorbed and held on the image recording drum 52, it is possible to perform the readout with high accuracy. Further, since the readout is performed immediately after the image recording, for example, abnormality of the ejection defect or the like can be immediately detected, and the measure to the abnormality can be quickly taken. Therefore wasteful recording can be prevented and occurrence of the damaged paper sheet can be controlled to the minimum.

Thereafter, the paper sheet P is, after the absorption is released, delivered to the ink drying processing part 20.

<Ink Drying Processing Part>

The ink drying processing part 20 performs the drying processing to the image-rerecorded paper sheet P to remove liquid components remaining on the surface of the paper sheet P. The ink drying processing part 20 includes a chain gripper 64 that conveys the image-rerecorded paper sheet P, a back tension applying mechanism 66 that applies the back tension to the paper sheet P conveyed by the chain gripper 64 and an ink drying processing unit 68 that performs the drying processing to the paper sheet P conveyed by the chain gripper 64.

The chain gripper 64 is a sheet conveying mechanism used in common to the ink drying processing part 20, the stamping processing part 200 and the sheet discharging part 24, and receives the paper sheet P delivered from the image recording part 18 to be conveyed to the sheet discharging part 24.

The chain gripper 64 includes first sprockets 64A arranged close to the image recording drum 52, second sprockets 64B mounted on the sheet discharging part 24, endless chains 64C wound around the first sprockets 64A and the second sprockets 64B, a plurality of chain guides (not illustrated) that guide travel of the chain 64C, and a plurality of gripers 64D attached on the chains 64C by constant intervals. The first sprockets 64A, the second sprockets 64B, the chains 64C and the chain guides are respectively configured to be paired and are arranged on both sides of the paper sheet P in the width direction. The plurality of grippers 64D are provided between the pair of the chains 64C, and both end parts of a tip end edge (illustrated in P1 in FIG. 2) of the paper sheet P are gripped by the plurality of grippers 64D.

The first sprockets 64A are mounted close to the image recording drum 52 such that the paper sheet P delivered from the image recording drum 52 can be received in the plurality of grippers 64D. The first sprockets 64A are supported on bearings that are not illustrated to be rotatably provided and connected to a motor that is not illustrated. The chains 64C wound around the first sprockets 64A and the second sprockets 64B travel by driving the motor.

The second sprockets 64B are mounted in the sheet discharging part 24 in such a manner as to be capable of collecting the paper sheet P received from the image recording drum 52 in the sheet discharging part 24. That is, the mounting position of the second sprocket 64B is designed to be a terminal end of the conveyance path of the paper sheet P by the chain gripper 64. The second sprocket 64B is supported on a bearing that is not illustrated and is rotatably provided.

The chains 64*c* are formed in an endless shape, and are wound around the first sprockets 64A and the second sprockets 64B.

The chain guides are arranged in a predetermined position to guide the chains 64C to travel in a predetermined path (that is, the paper sheet P is guided to travel and be conveyed in a predetermined path). In the inkjet recording apparatus 10 of the present example, the second sprockets 64B are in a position higher than the first sprockets 64A. Therefore a travel path is formed in such a manner that the chain 64C is inclined in the half way. Specifically the travel path includes a first horizontal conveyance path 70A, an inclined conveyance path 70B and a second horizontal conveyance path 70C.

The first horizontal conveyance path 70A is set to the same height with the first sprocket 64A, and is set such that the chain 64C wound around the first sprocket 64A travels horizontally.

The second horizontal conveyance path 70C is set to the same height with the second sprocket 64B, and is set such that the chain 64C wound around the second sprocket 64B travels horizontally.

The inclined conveyance path 70B is provided between the first horizontal conveyance path 70A and the second horizontal conveyance path 70C and is set for connection between the first horizontal conveyance path 70A and the second horizontal conveyance path 70C.

The chain guides are arranged to form the first horizontal conveyance path 70A, the inclined conveyance path 70B and the second horizontal conveyance path 70C. Specifically the chain guides are arranged at least in a joint point between the first horizontal conveyance path 70A and the inclined conveyance path 70B and in a joint point between the inclined conveyance path 70B and the second horizontal conveyance path 70C.

The paired grippers 64D arc attached on the chains 64C by constant intervals. The attaching interval of the gripper 64D is set to correspond to the receiving interval of the paper sheet P from the image recording drum 52. That is, the attaching interval of the gripper 64D is set to correspond to the receiving interval of the paper sheet P from the image recording drum 52 such that the paper sheets P delivered in order from the image recording drum 52 can be received from the image recording drum 52 timed to the delivery.

The chain gripper 64 is configured as described above. With this configuration, when a motor (not illustrated) connected to the first sprocket 64A is driven as described above, the chain 64C travels. The chain 64C travels in the same speed as the peripheral speed of the image recording drum 52. The paper sheet P delivered from the image recording drum 52 is timed to be capable of being received in each of the grippers 64D.

The back tension applying mechanism 66 applies the back tension to the paper sheet P conveyed while tip end thereof is gripped by the chain gripper 64. The back tension applying mechanism 66 includes guide plates 72, and a suction mechanism (not illustrated) that sucks air from suction holes (not illustrated) formed on the guide plates 72.

The guide plates 72 are each configured with a hollow box plate having a width corresponding to the sheet width. The guide plates 72 are arranged along the conveyance path (that is, travel path of the chain) of the paper sheet P by the chain gripper 64. Specifically the guide plates 72 are arranged along the chain 64C traveling on the first horizontal conveyance path 70A and the inclined conveyance path 70B and are arranged at a predetermined distance from the chain 64C. The paper sheet P conveyed from the chain gripper 64 is conveyed while the backside (surface of the side where an image is not recorded) is making sliding contact with upper surfaces (surfaces opposing the chain 64C: sliding contact surfaces) of the guide plates 72.

Multiple suction holes (not illustrated) are formed in a predetermined pattern on the sliding contact surface (upper surface) of each guide plate 72. As described above, the guide plates 72 are each formed with the hollow box plate. The suction mechanism (not illustrated) sucks hollow parts (internal parts) of the guide plates 72. Thereby air is sucked through the suction holes formed on the sliding contact surface.

When the air is sucked through the suction holes of the guide plates 72, the backside of the paper sheet P conveyed by the chain gripper 64 is sucked to the suction holes. Thereby the back tension is applied to the paper sheet P conveyed by the chain gripper 64.

As described above, since the guide plates 72 are arranged along the chain 64C traveling on the first horizontal conveyance path 70A and the inclined conveyance path 70B, the back tension is applied while the paper sheet P is conveyed on the first horizontal conveyance path 70A and the inclined conveyance path 70B.

The ink drying processing unit 68 is mounted in an internal part (particularly a section configuring the first horizontal conveyance path 70A) of the chain gripper 64, and performs drying processing to the paper sheet P conveyed on the first horizontal conveyance path 70A. The ink drying processing unit 68 blows heated air on the surface of the paper sheet P conveyed on the first horizontal conveyance path 70A to perform the drying processing. The ink drying processing unit 68 includes a plurality of units arranged along the first horizontal conveyance path 70A. The mount number is set according to processing capabilities of the ink drying processing unit 68 and a conveyance speed (=printing speed) of the paper sheet P. That is, the mount number is set such that the paper sheet P can be dried while the paper sheet P received from the image recording part 18 is being conveyed on the first horizontal conveyance path 70A. Accordingly a length of the first horizontal conveyance path 70A is also set in consideration of capabilities of the ink drying processing unit 68.

When the drying processing is performed, humidity of the ink drying processing part 20 increases. When the humidity increases, since the drying processing cannot be efficiently performed, it is preferable that a discharging device is mounted together with the ink drying processing unit 68 in the ink drying processing part 20 to forcibly discharge wet air generated by the drying processing. The discharging device, for example, is configured such that a discharging duct is mounted in the ink drying processing part 20 to discharge air in the ink drying processing part 20.

The ink drying processing part 20 is configured as described above. With this configuration, the paper sheet P delivered from the image recording drum 52 in the image recording part 18 is received in the chain gripper 64. The chain gripper 64 grips the tip end of the paper sheet P by the gripper 64D, and thereby conveys the paper sheet P along the planar guide plate 72. The paper sheet P delivered in the chain gripper 64 is first conveyed on the first horizontal conveyance path 70A. The paper sheet P in the process conveyed on the first horizontal conveyance path 70A is subjected to drying processing by the ink drying processing unit 68 mounted inside the chain gripper 64. That is, the heated air is blown on the surface (image recording surface) to perform the drying processing. At this time, the paper sheet P is subjected to the drying processing while the back tension is applied to the paper sheet P by the hack tension applying mechanism 66. As a result, the drying processing can be performed while suppressing a deformation of the paper sheet P.

<Stamping Processing Part>

The stamping processing part 200 is provided downstream of the ink drying processing part 20 in the conveyance direction of the paper sheet P and upstream of the sheet discharging part 24 in the same direction to cause inks to adhere to a tip end edge P1 (refer to FIG. 2) of the paper sheet P in which the image defect is generated or a tip end edge P1 of the paper sheet P corresponding to the sorting sheet number. Thereby defect paper sheets are specified from the paper sheets P stacked on the sheet discharging part 24 or a sorting section managing the sorting sheet number is specified.

In the present embodiment, the stamping processing part 200 is provided downstream of the ink drying processing part 20, but may be provided downstream of the image recording part 18, and when the structure of the conveyance part is formed such that the stamping processing part 200 can be arranged, the stamping processing part 200 may be provided downstream of the image recording part 18 (the details will be described later).

<Sheet Discharging Part>

The sheet discharging part 24 collects the paper sheets P subjected to a series of the image recording processing. The sheet discharging part 24 includes the chain grippers 64 that convey the paper sheet P and a sheet discharging platform 76 that stacks the paper sheets P for collection.

As described above, the chain grippers 64 are used in common together with the ink drying processing part 20 and the stamping processing part 200. The chain grippers 64 release the paper sheets P on the sheet discharging platform 76 and stack the paper sheets P on the sheet discharging platform 76.

The sheet discharging platform 76 stacks the paper sheets P released from the chain grippers 64 for collection. The sheet discharging platform 76 is, for stacking the paper sheets P in order thereon, provided with sheet guides (a front sheet guide, a rear sheet guide, a side sheet guide and the like) (not illustrated).

The sheet discharging platform 76 is provided to be capable of going up and down by a sheet-discharging platform elevating device that is not illustrated. The sheet-discharging platform elevating device is controlled in driving in association with an increase/decrease of paper sheets P stacked on the sheet discharging platform 76, and causes the sheet discharging platform 76 to go up and down such that the paper sheet P positioned on the top is always positioned in a constant height position.

<<Detailed Description of Stamping Processing Part>>

Figure 2:
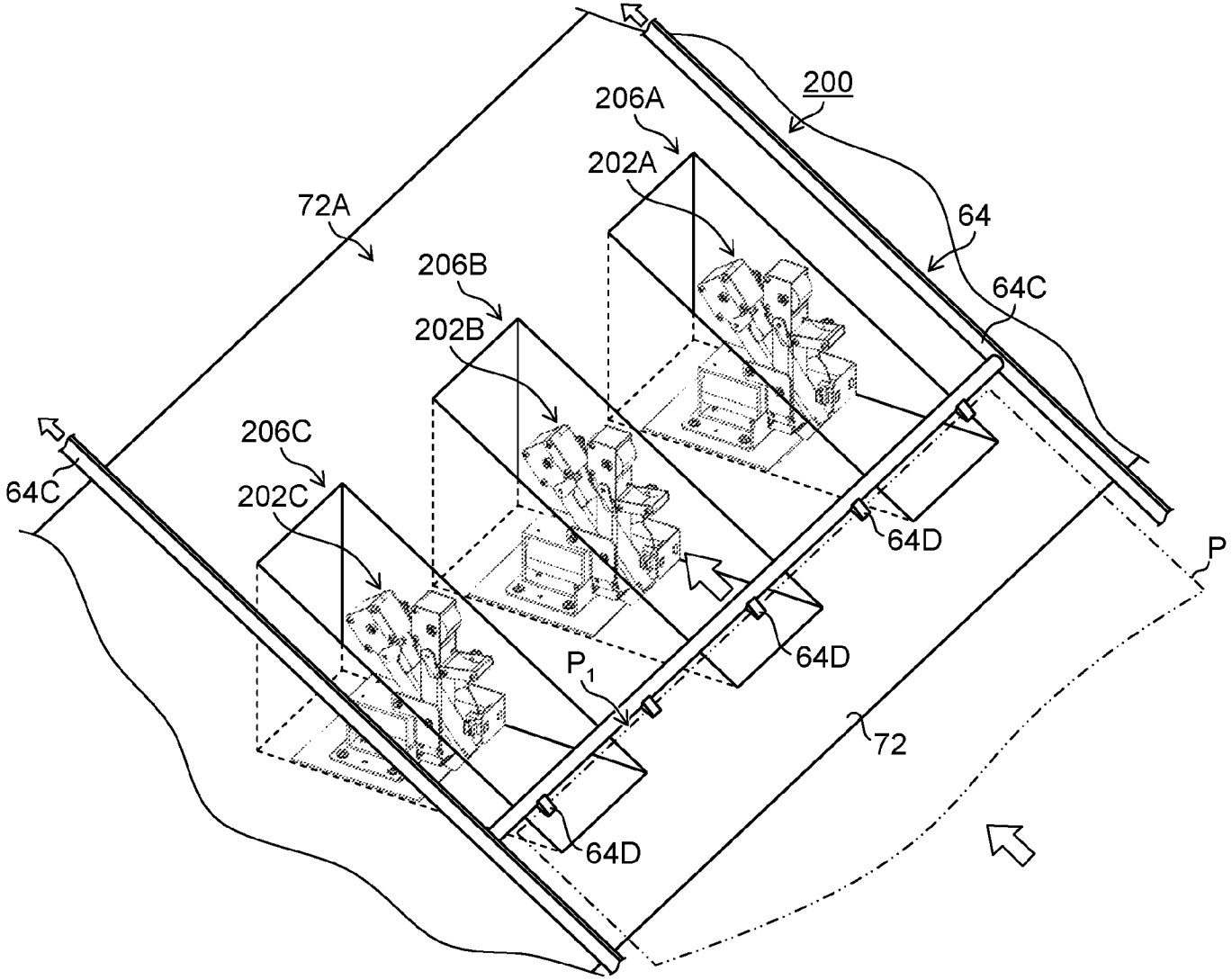
FIG. 2 is a perspective view illustrating an arrangement example of a stamping processing part in FIG. 1.
Figure 3:
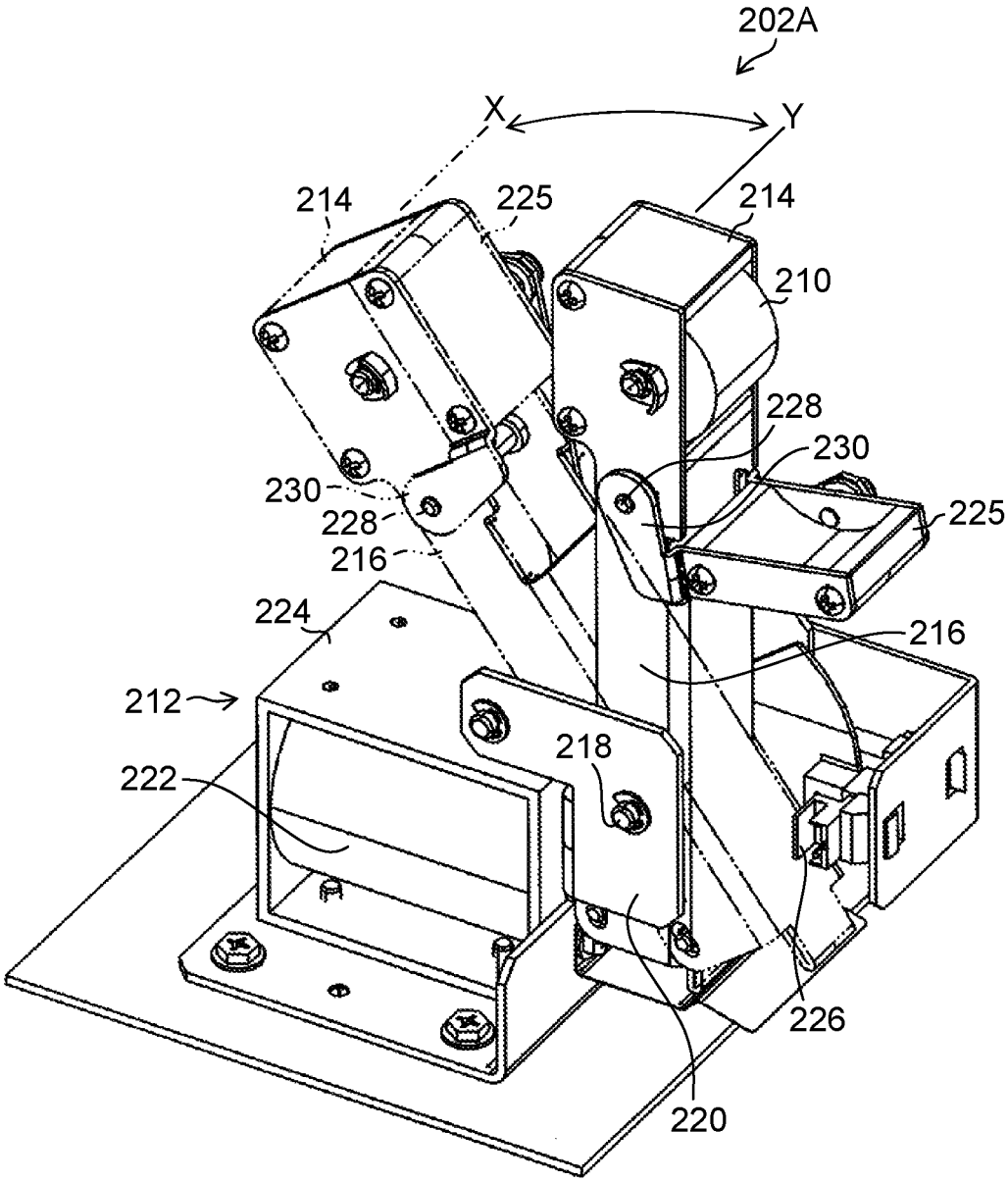
FIG. 3 is an entire configuration diagram illustrating configurations of a first, second and third stamping devices.

FIG. 2 is a perspective view illustrating an arrangement example of the stamping processing part 200, and FIG. 3 is an entire configuration diagram of first, second and third stamping devices 202A, 202B and 202C configuring the stamping processing part 200. In FIG. 2, for illustrative purposes, reference characters indicating the elements of the first, second and third stamping devices 202A, 202B and 202C are omitted.

As illustrated in FIG. 2, the stamping processing part 200 includes the first stamping device 202A, the second stamping device 202B and the third stamping device 202C. The first stamping device 202A, the second stamping device 202B and the third stamping device 202C are respectively accommodated in casings 206A, 206B and 206C (illustrated in a broken line) upper surfaces of which open obliquely along the inclined conveyance path 70B of the chain grippers 64, and the casings 206A, 206B and 206C are arranged in a lower position of the inclined conveyance path 70B.

A length found by adding the respective widths of the casings 206A, 206B and 206C is made to less than an arrangement width of the plurality of chain grippers 64. Therefore the first stamping device 202A, the second stamping device 202B and the third stamping device 202C are arranged between the pair of the chains 64C. The first stamping device 202A, the second stamping device 202B and the third stamping device 202C are arranged between the grippers in the width direction of the paper sheet P.

The first stamping device 202A, the second stamping device 202B and the third stamping device 202C adopt an arrangement in which stamp positions to the paper sheet P are the same position in the conveyance direction of the paper sheet P. The first stamping device 202A, the second stamping device 202B and the third stamping device 202C may be arranged to be shifted in the conveyance direction of the paper sheet P.

"The same position" herein includes "the substantially same position" of being capable of achieving the same operational effect.

Since the first stamping device 202A, the second stamping device 202B and the third stamping device 202C are arranged in different positions in the width direction of the paper sheet P perpendicular to the conveyance direction of the paper sheet P, ink adherence positions do not overlap in the width direction of the paper sheet P.

The term of "perpendicular" in the present specification includes a substantially perpendicular range of angles less than or more than 90° C.

Figure 4:
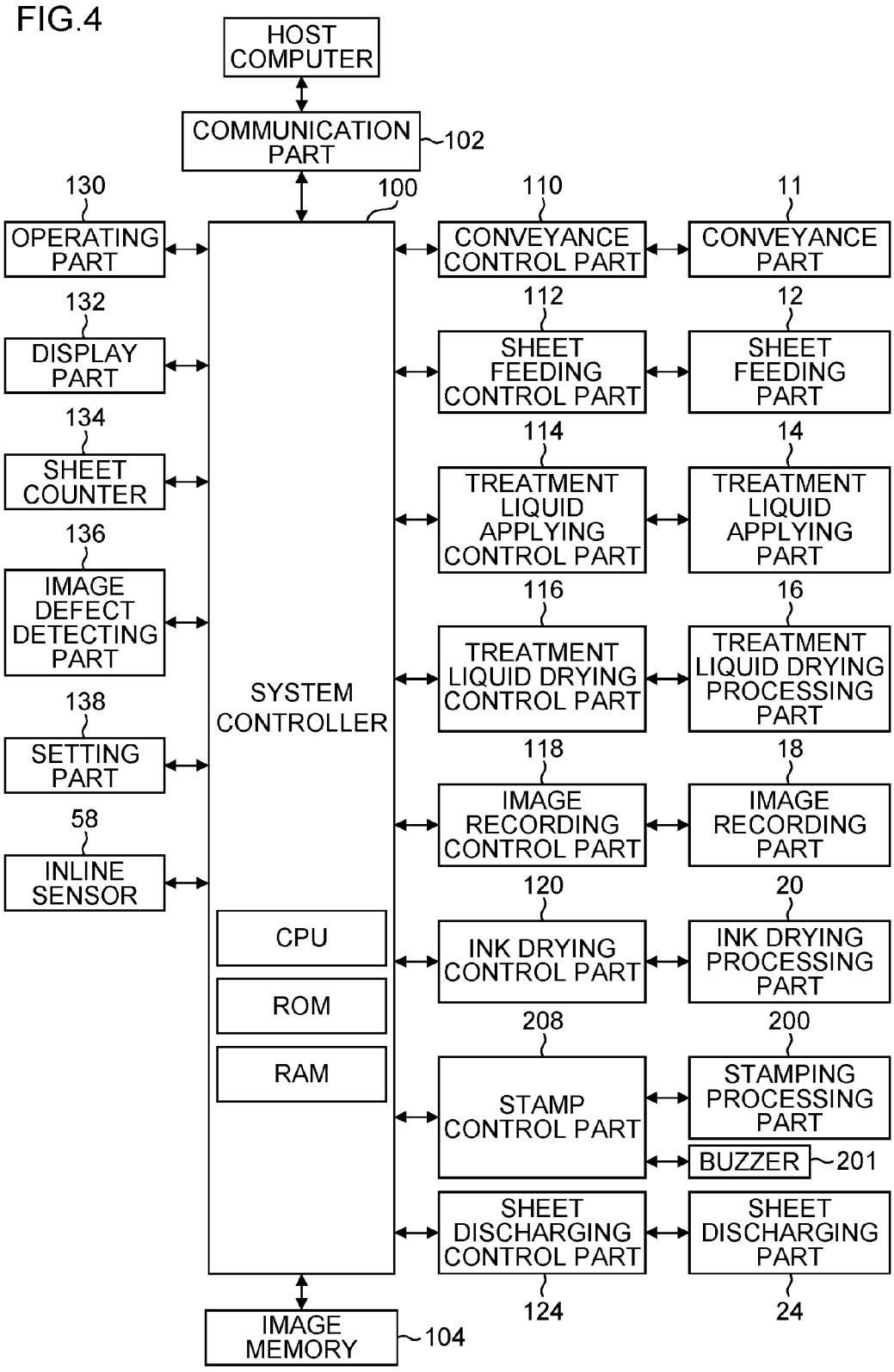
FIG. 4 is a block diagram illustrating a schematic configuration of a control system in the inkjet recording device.

The first stamping device 202A, the second stamping device 202B and the third stamping device 202C cause inks to adhere to the tip end edge P1 of the paper sheet P in which an image defect is generated based upon the readout result of the inline sensor 58 (refer to FIG. 1), in response to an instruction signal sent out from the stamp control part (not illustrated in FIG. 2 and FIG. 3 but illustrated in reference numeral 208 in FIG. 4).

Next, the structure of each of the first stamping device 202A, the second stamping device 202B and the third stamping device 202C will be explained with reference to FIG. 2 and FIG. 3. The first stamping device 202A, the second stamping device 202B and the third stamping device 202C may adopt the same configuration. In the following explanation, the first stamping device 202A will be explained as a representative of the first stamping device 202A, the second stamping device 202B and the third stamping device 202C.

As illustrated in FIG. 2 and FIG. 3, the first stamping device 202A includes a stamp roller 210 (stamp part) in which ink is immersed and a projectable/retractable mechanism 212 that causes the stamp roller 210 to project/retract from the chain gripper 64.

The stamp roller 210 is rotatably supported in a stamp vessel 214, which is supported in the projectable/retractable mechanism 212.

The projectable/retractable mechanism 212 includes arms 216 (stamp movement parts) that supports the stamp vessel 214 in the tip end part, support plates 220 (stamp movement parts) that rotatably support the arms 216 through a rotational shaft 218, and a solenoid actuator 222 (stamp movement parts) that rotates the arms 216 about the rotational shaft 218 to move the stamp vessel 214 between the a waiting position X and a stamp position Y.

As illustrated in FIG. 2 and FIG. 3, the stamp vessel 214 positioned in the waiting position X and in the retractable state where the stamp vessel 214 does not project from an opening of each of the casings 206A, 206B and 206C, and the like are illustrated in a two-dot chain line, and the stamp vessel 214 positioned in the stamp position Y and in the projectable state where the stamp vessel 214 projects from the opening of each of the casings 206A, 206B and 206C, and the like are illustrated in a solid line.

In regard to a relation of the arms 216 in the first stamping device 202A, the support plates 220 and the solenoid actuator 222, a support structure of each other is formed when the arms 216 are rotatably supported to the support plates 220, the support plates 220 are supported to an outer frame part 224 of the solenoid actuator 222 and the outer frame part 224 is fixed to a bottom surface of the casing 206A.

In a case of forming the arm 216 with a material of a resin or the like not absorbed by a magnetic force other than a metal capable of being absorbed to a magnetic force of a solenoid, a metallic plate for absorption is attached to a base end part of the arm 216.

ON/OFF of the solenoid actuator 222 is controlled in response to an instruction signal to be sent out from the stamp control part (refer to FIG. 4). That is, when the solenoid actuator 222 is ON, an exciting current flows in a coil that is not illustrated in the solenoid actuator 222 to generate a magnetic field by the exciting current, and the base end parts of the arms 216 are pulled to the solenoid actuator 222 by a function of the magnetic field.

Then, the arms 216 waiting in an inclined state rise up, the stamp vessel 214 supported by the tip end parts of the arms 216 moves from the waiting position X to the stamp position Y, and the stamp vessel 214 appears from downward to upward of the chain grippers 64 (from the opening of the casing 206A).

Since the first stamping device 202A includes a latch mechanism that holds a state of the arm 216 risen once, even after the exciting current flowing in the coil of the solenoid actuator 222 is OFF to disperse the magnetic field, the rising state of the arms 216 is held.

The stamp vessel 214 is provided with an opening/closing lid 225 that opens/closes in association with the projectable/retractable mechanism 212 to expose a stamp surface of the stamp roller 210 from the stamp vessel 214 or tightly closes the stamp roller 210. An opening/closing mechanism of the opening/closing lid 225 includes an optical sensor 226 (position detecting part) that detects a base end part position (home position) of the arms 216, and an opening/closing actuator (not illustrated) that opens/closes the opening/closing lid 225 based upon the detection result of the optical sensor 226.

That is, when the arms 216 move to the stamp position Y and the base end parts of the arms 216 are not detected by the optical sensor 226 (OFF state), the opening/closing actuator drives to open the opening/closing lid 225.

In addition, when the arms 216 move to the waiting position X and the base end parts of the arms 216 are detected by the optical sensor 226 (ON state), the opening/closing actuator drives to close the opening/closing lid 225. In other words, the opening/closing lid 225 opens/closes in association with projection/retraction of the stamp vessel 214 with rotation of the arms 216.

An example of the opening/closing mechanism of the opening/closing lid 225 may include a system of opening/closing the opening/closing lid 225 by supporting the opening/closing lid 225 to support anus 230 through a rotational pin 228 to the stamp vessel 214 and rotating the rotational pin 228 by a motor.

The paper sheet P is conveyed in a direction indicated in a void arrow line, and the tip end edge P1 of the paper sheet P abuts on the stamp roller 210 (the opening/closing lid of the stamp vessel is in an open state) positioned in the stamp position Y to cause ink to adhere to the tip end edge P1.

The solenoid actuator 222 is OFF immediately before the paper sheet P abuts on the stamp roller 210 for the arms 216 to fall with momentum of abutment of the paper sheet P on the stamp vessel 214. Therefore since the stamp vessel 214 retracts in the downward side of the chain grippers 64 (since it is accommodated in the casing 206A), the conveyance of a normal paper sheet P to be conveyed subsequently is not interrupted.

The first stamping device 202 is provided with a stopper mechanism (not illustrated) that stops the arms 216 in the waiting position X.

In the present embodiment, the projectable/retractable mechanism of the stamp vessel 214 is configured such that the arms 216 rotate to be risen/fallen, thereby causing the stamp roller 210 to project/retract to the chain grippers 64, but is not limited to this system if the similar operation is possible.

<<Control System>>

FIG. 4 is a block diagram illustrating a schematic configuration of a control system of the inkjet recording apparatus 10 according to the present embodiment.

As illustrated in FIG. 4, the inkjet recording apparatus 10 includes a system controller 100, a communication part 102, an image memory 104, a conveyance control part 110, a sheet feeding control part 112, a treatment liquid applying control part 114, a treatment liquid drying control part 116, an image recording control part 118, an ink drying control part 120, a stamp control part 208 (a first stamp control part and a second stamp control part), a sheet discharging control part 124, an operating part 130, a display part 132 and a sheet counter 134.

The system controller 100 works as a control device that integrally controls the respective parts in the inkjet recording apparatus 10 and a calculation device that performs various types of calculation processing. The system controller 100 includes a CPU (central processing unit), a ROM (read only memory) and a RAM (random access memory). The system controller 100 operates according to predetermined control programs and controls the respective parts in the inkjet recording apparatus 10 upon reception of operating inputs through the operating part 130 from an operator. The control program to be executed by the system controller 100 and various types of data necessary for the control are stored in the ROM.

The operating part 130 includes an operating device (for example, operating buttons, a key board, a touch panel and the like), and outputs operating information input from the operating device to the system controller 100.

The communication part 102 includes a required communication interface, and performs transmission/reception of data to a host computer connected to the communication interface.

The image memory 104 works as a temporary memory device of various types of data including the image data, and performs the reading and writing of the data through the system controller 100. The image data taken in through the communication part 102 from the host computer is stored in the image memory 104.

The conveyance control part 110 controls the conveyance part 11 of paper sheets P in the inkjet recording apparatus 10. That is, the conveyance control part 110 controls drives of a tape feeder 36A, a front guide 38 and the sheet feeding drum 40 in the sheet feeding part 12, and controls drives of the treatment liquid applying drum 42 in the treatment liquid applying part 14, the treatment liquid drying processing drum 46 in the treatment liquid drying processing part 16 and the image recording drum 52 in the image recording part 18. The conveyance control part 110 controls drives of the chain grippers 64 and the back tension applying mechanism 66 used in common in the ink drying processing part 20 and the sheet discharging part 24.

The conveyance control part 110 controls the conveyance part 11 according to an instruction from the system controller 100 such that the paper sheets P are conveyed from the sheet feeding part 12 to the sheet discharging part 24 without any delay.

The sheet feeding control part 112 controls the sheet feeding part 12 according to an instruction from the system controller 100. Specifically drives of the sucker device 32, the sheet-feeding platform elevating mechanism and the like are controlled such that the paper sheets P stacked on the sheet feeding platform 30 are fed in order one by one without overlapping.

The treatment liquid applying control part 114 controls the treatment liquid applying part 14 according to an instruction from the system controller 100. Specifically the treatment liquid applying control part 114 controls a drive of the treatment liquid applying unit 44 such that the treatment liquid is applied on the paper sheet P conveyed by the treatment liquid applying drum 42.

The treatment liquid drying control part 116 controls the treatment liquid drying processing part 16 according to an instruction from the system controller 100. Specifically a drive of the treatment liquid drying processing unit 50 is controlled such that the paper sheet P conveyed by the treatment liquid drying processing drum 46 is subjected to drying processing.

The image recording control part 118 controls the image recording part 18 according to an instruction from the system controller 100. Specifically drives of the inkjet heads 56C, 56M, 56Y and 56K are controlled such that a predetermined image is recorded on the paper sheet P conveyed by the image recording drum 52. The image recording control part 118 controls an operation of the inline sensor 58 for the recorded image to be read out.

The ink drying control part 120 controls the ink drying processing part 20 according to an instruction from the system controller 100. Specifically a drive of the ink drying processing unit 68 is controlled to cause the heated air to be blown on the paper sheet P conveyed by the chain grippers 64.

The stamp control part 208 controls operations of the stamping processing part 200 (the first, second and third stamping devices 202A, 202B and 202C illustrated in FIG. 2 and FIG. 3) and a buzzer 201 according to an instruction from the system controller 100.

The sheet discharging control part 124 controls the sheet discharging part 24 according to an instruction from the system controller 100. Specifically drives of the sheet-discharging platform elevating mechanism and the like are controlled for the paper sheets P to stack on the sheet discharging platform 76.

For example, in a case of sorting the paper sheets P stacked on the sheet discharging part 24 by the sheet number of every 100 sheets, the sorting sheet number is input from the operating part 130. The input sorting sheet number is stored as a sorting sheet number setting value. The sorting sheet number setting value is read out to the stamp control part 208, which is applied to the control of the stamping processing part 200.

The setting part 138 illustrated in FIG. 4 is a block that performs various types of settings such as a setting of the sorting sheet number, and includes a setting value obtaining part that obtains the setting, a setting value storing part that stores the obtained setting value, and a memory control part that controls write-in and readout of the setting value to the setting value storing part.

The display part 132 includes a required display device (for example, an LCD (liquid crystal display) panel and the like), and causes required information to be displayed on the display device according to an instruction from the system controller 100.

The sheet counter 134 is a device that counts the sheet number of the paper sheets P fed from the sheet feeding part 12. The sheet number information of the paper sheets P obtained from the sheet counter 134 is sent out to the stamp control part 208 through the system controller 100, which is applied to the control of the stamping processing part 200.

The image defect detecting part 136 detects whether or not a defect is generated in the image formed on the paper sheet P. Presence/absence of the image defect is determined based upon the imaging pickup result of the inline sensor 58. The detection result is sent out to the stamp control part 208 through the system controller 100, which is applied to the control of the stamping processing part 200. As explained before, the dirt detecting part that detects the dirt of the paper sheet P may be provided to determine the dirt of the paper sheet P as the image defect.

The buzzer 201 is a device that issues a warning for a constant period based upon control of the stamp control part 208 in a case where a stamp execution condition by the first stamping device 202 is established. Instead of the buzzer 201 or together therewith, at least one of lighting-on, blinking and lighting-off of a lamp, and a display by character information to the display part may be applied.

<<Description of Image Recording>>

Image data recorded on a paper sheet is taken in the inkjet recording apparatus 10 through the communication part 102 from the host computer. The taken image data is stored in the image memory 104.

The system controller 100 executes required signal processing to the image data stored in the image memory 104 to generate dot data. A drive of each of the inkjet heads 56C, 56M, 56Y and 56K in the image recording part 18 is controlled according to the generated dot data to record an image expressed by the image data on a paper sheet.

The dot data is generally generated by executing color conversion processing and halftone processing to the image data. The color conversion processing is processing of converting image data (for example, image data of RGB eight bits) expressed by sRGB (standard RGB) or the like into ink amount data of each color of inks used in the inkjet recording apparatus 10 (in the present example, converted into ink amount data of each color of C, M, Y and K). The halftone processing is processing of converting the ink amount data of each color generated by the color conversion processing into dot data of each color in the processing of error dispersion or the like.

The system controller 100 executes the color conversion processing and the halftone processing to the image data to generate dot data of each color. According to the generated dot data of each color, a drive of the corresponding inkjet head is controlled to record an image expressed by the image data on a paper sheet P.

In the present embodiment, the opening/closing lid 225 of the stamp vessel 214 opens/closes in association with a projectable/retractable operation of the stamp vessel 214 by the solenoid actuator 222. Therefore it is possible to prevent the ink on the stamp roller 210 from drying in the waiting period of not performing the stamp.

In this case, when inks (stamp inks) used in the first, second and third stamping devices 202A, 202B and 202C are formed of a water-retentive material, the drying of the ink of the stamp roller 210 can be further prevented.

The present example illustrates a unit form where the first, second and third stamping devices 202A, 202B and 202C are respectively accommodated in the casings 206A, 206B and 206C, and the device that controls operations of the first, second and third stamping devices 202A, 202B and 202C is commonalized, but devices for controlling operations of the first, second and third stamping devices 202A, 202B and 202C may be separately provided. A part of the devices that control the operations of the first, second and third stamping devices 202A, 202B and 202C may be commonalized.

The present example exemplifies the rotational operation of the arms 216 as the projectable/retractable operations of the first, second and third stamping devices 202A, 202B and 202C, but the form of causing the stamp vessel 214 to go up and down is also possible.

The present example exemplifies the inkjet recording apparatus 10 in which the coated paper is applied as the paper sheet P, but the presently disclosed subject matter may adopt a sheet-shaped material and a substrate other than the paper, such as a resin sheet (substrate), a metallic sheet (substrate) or a glass substrate as the paper sheet P.

An application range of the presently disclosed subject matter is not limited to the image forming apparatus (printing apparatus) for graphic use. The presently disclosed subject matter can be applied widely to, for example, an industrial image forming apparatus such as a pattern forming apparatus that forms a wiring pattern and a mask pattern on a substrate.

[Stamp Imprinting Processing]

Figure 5:
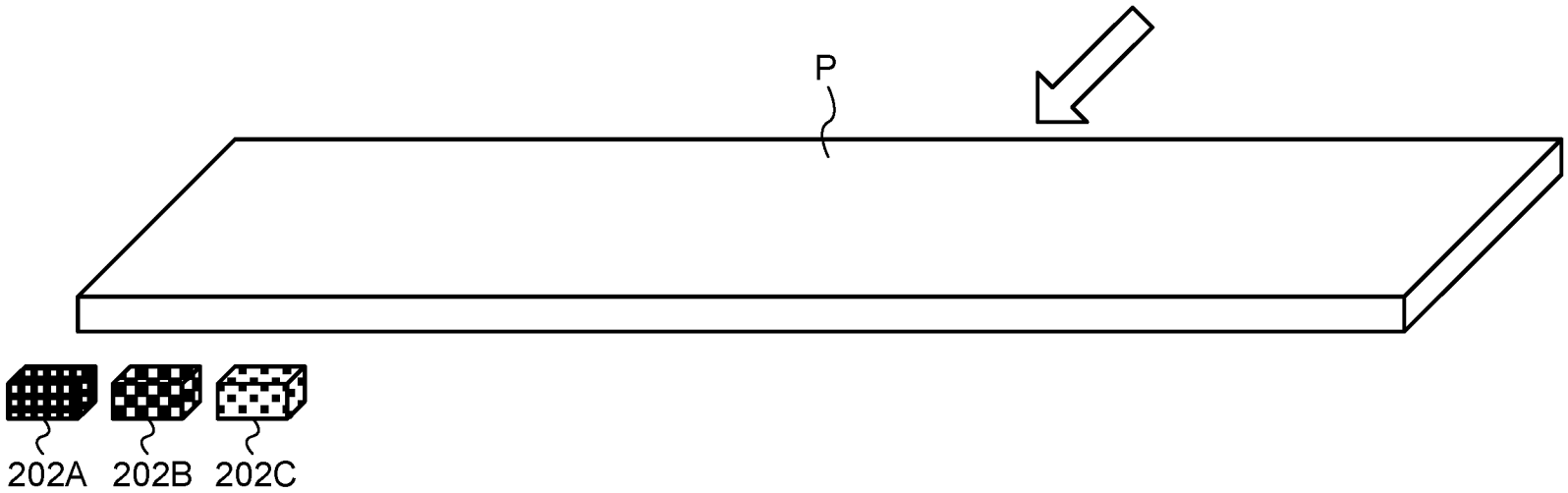
FIG. 5 is a perspective view schematically illustrating the first, second and third stamping devices and a print sheet.
Figure 6:
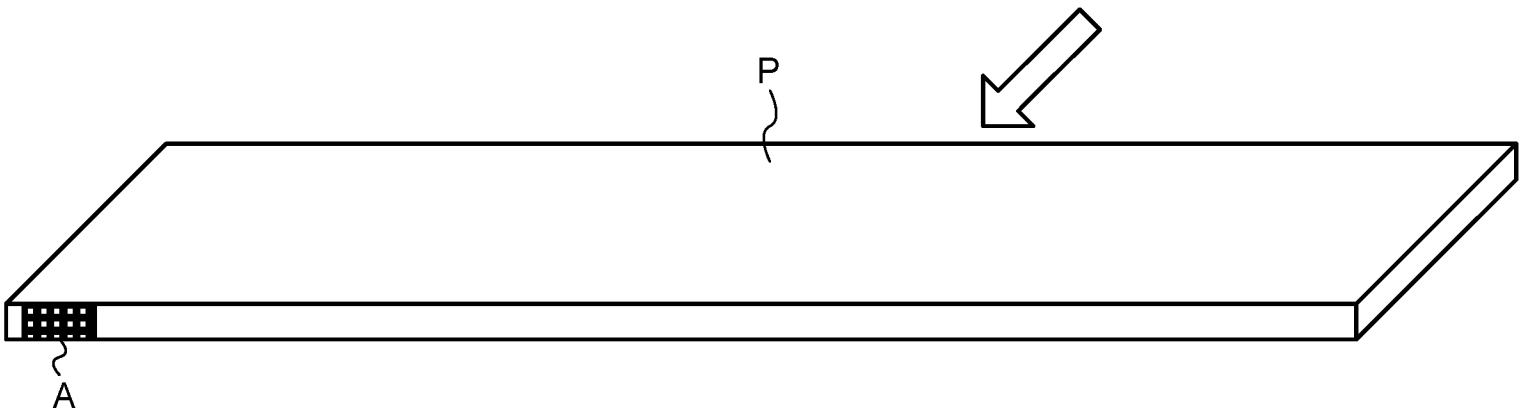
FIG. 6 is a perspective view illustrating an example where a stamp is imprinted on the print sheet.

FIG. 5 is a perspective view schematically illustrating the first, second and third stamping devices and a print sheet, and FIG. 6 is a perspective view illustrating an example where a stamp is imprinted on a paper sheet. An arrow in each of FIG. 5 and FIG. 6 indicates the conveyance direction of a paper sheet P.

As illustrated in FIG. 5, the first stamping device 202A, the second stamping device 202B and the third stamping device 202C can attach stamps having different colors with each other to different positions. In the present embodiment, the first stamping device 202A, the second stamping device 202B and the third stamping device 202C respectively attach the stamps of colors A, B and C.

The image defect detecting part 136 measures an ejection curve amount of a nozzle (error of a dot position) from an image on a paper sheet P of an inspection object (measurement object) output from the inline sensor 58. The image defect detecting part 136 outputs the measurement result of the ejection curve amount of the nozzle to the system controller 100. Here, the ejection curve amount of the nozzle (error of the dot position) can be measured, for example, using a dot position measuring method described in Japanese Patent Application Laid-Open No. 2011-079257 (paragraphs [0092] and subsequent thereto).

In the present embodiment, not only the ejection curve amount of the nozzle but also a streak due to non-ejection can be detected. For example, the non-ejection can be detected assumed as an equivalent to a case where the ejection curve amount of the nozzle is the largest.

The system controller 100 controls the stamp control part 208 according to the data of the measurement result of the ejection curve amount of the nozzle input from the image defect detecting part 136 and causes the stamp control part 208 to imprint a stamp according to the data of the measurement result of the ejection curve amount of the nozzle on a paper sheet P of an inspection object. For example, when the ejection curve amount of the nozzle is indicated at x, in a case where x>17 μm, a stamp of color A is imprinted by the first stamping device 202A, in a case where 13 μm<x≤17 μm, a stamp of color B is imprinted by the second stamping device 202B, and in a case where 7 μm≤x≤13 μm, a stamp of color C is imprinted by the third stamping device 202C. Therefore an operator can visually recognize the ejection curve amount of the nozzle based upon the color of the stamp.

The measurement result of the ejection curve amount may differ for each nozzle.

For example, when the measurement result of the ejection curve amount of the nozzle in a nozzle i is indicated at $x_i$, $x_i$>17 μm (case where a stamp of color A is to be imprinted), when the measurement result of the ejection curve amount of the nozzle in a nozzle j is indicated at $x_j$, 13 μm<$x_j$≤17 μm (case where a stamp of color B is to be imprinted), and when the measurement result of the ejection curve amount of the nozzle in a nozzle k is indicated at $x_k$, 7 μm≤$x_k$≤13 μm (case where a stamp of color C is to be imprinted).

In the above case, a stamp (stamp A in the above example) corresponding to a case where the measurement result of the ejection curve amount of the nozzle is the largest (stamp condition 1) may be imprinted. In a case of the stamp condition 1, a stamp corresponding to a case where the measurement result of the ejection curve amount of the nozzle in a paper sheet P of an inspection object is the largest is imprinted. Therefore an operator can confirm the extent of a streak having the highest visibility in the paper sheet P of the inspection object based upon the color of the stamp. As a result, an operator can efficiently inspect only the streak having the relatively high visibility.

In the above case, a stamp (stamp C in the above example) corresponding to a case where the measurement result of the ejection curve amount of the nozzle is the smallest (stamp condition 2) may be imprinted. In a case of the stamp condition 2, a stamp corresponding to a case where the measurement result of the ejection curve amount of the nozzle in a paper sheet P of an inspection object is the smallest is imprinted. Therefore an operator can confirm the extent of a streak having the lowest visibility in the paper sheet P of the inspection object based upon the color of the stamp. As a result, an operator can perform an accurate inspection in regard to the streak having the relatively low visibility.

In the present embodiment, the stamp condition is changeable by the operating part 130, and an operator can select, according to the kind of a paper sheet P of an inspection object, the stamp condition 1 in a case where the number of the paper sheets P of the inspection object is large and required accuracy of the inspection is relatively low, and the stamp condition 2 in a case where the number of the paper sheets P of the inspection object is small and required accuracy of the inspection is relatively high.

In regard to a threshold for determining whether or not a stamp is imprinted and which color stamp is imprinted, it is preferable to change the threshold for each color as illustrated in Table 1 in terms of visibility for each color.

TABLE 1

| SETTING | K | C and M | Y |
|---|---|---|---|
| HIGH | 7 μm | 10 μm | 15 μm |
| MIDDLE | 13 μm | 13 μm | 17 μm |
| LOW | 17 μm | 17 μm | 19 μm |

In general, a streak of a K ink has the highest visibility, and a streak of a Y ink has the lowest visibility. The visibility of the streak of each of a C ink and an M ink is an intermediate level between K and Y. In an example illustrated in Table 1, a threshold used for determination of the K ink is set to the smallest (detection accuracy is the highest) and a threshold used for determination of the Y ink is set to the largest (detection accuracy is the lowest) in terms of a difference in visibility for each color.

No detection of the streak of the Y ink may be performed in terms of low visibility of the Y ink.

Further, detection of the streak of the K ink having the highest visibility to the streak may be first performed, detection of the streak of the C ink or M ink may be next performed, and detection of the streak of the Y ink having the lowest visibility to the streak may be finally performed.

In the example illustrated in Table 1, in a case of the K ink, when the measurement result of the ejection curve amount of the nozzle is indicated at x, in a case where x>17 μm (low), a stamp of color A is imprinted by the first stamping device 202A, in a case where 13 μm<x≤17 μm (middle), a stamp of color B is imprinted by the second stamping device 202B, and in a case where 7 μm≤x≤13 μm (high), a stamp of color C is imprinted by the third stamping device 202C.

In a case of the C ink and M ink, when the measurement result of the ejection curve amount of the nozzle is indicated at x, in a case where x>17 μm (low), a stamp of color A is imprinted by the first stamping device 202A, in a case where 13 μm<x≤17 μm (middle), a stamp of color B is imprinted by the second stamping device 202B, and in a case where 10 μm≤x≤13 μm (high), a stamp of color C is imprinted by the third stamping device 202C.

In a case of the Y ink, when the measurement result of the ejection curve amount of the nozzle is indicated at x, in a case where x>19 μm (low), a stamp of color A is imprinted by the first stamping device 202A, in a case where 17 μm<x≤19 μm (middle), a stamp of color B is imprinted by the second stamping device 202B, and in a case where 15 μm≤x≤17 μm (high), a stamp of color C is imprinted by the third stamping device 202C.

In the example illustrated in Table 1, three thresholds are used for determination of the defect nozzle, and the extent in defect of the defect nozzle (evaluation of the streak) is classified into four stages of "high", "middle" "low", and "no stamp" (OFF), but the presently disclosed subject matter is not limited thereto.

In the example illustrated in Table 1, for example, in a case where the determination result of the nozzle of the K ink is made as "low", the determination result of the nozzle of the C ink is made as "high", and the determination result of the nozzle of the Y ink is made as "high", all the stamps (the stamps A and C in the above example) corresponding to the determination results may be imprinted (stamp condition 3).

In the above case, the stamp (stamp A in the above example) corresponding to the lowest result in the ejection curve amount of the nozzle (stamp condition 4) may be imprinted. In a case of the stamp condition 4, since the stamp corresponding to the largest result in the ejection curve amount of the nozzle in the paper sheet P of the inspection object is imprinted, an operator can confirm the extent of the streak having the highest visibility based upon the color of the stamp, in the paper sheet P of the inspection object. As a result, an operator can efficiently inspect only the streak having a relatively high visibility.

In the above case, the stamp (stamp C in the above example) corresponding to the highest determination result in the ejection curve amount of the nozzle may be imprinted (stamp condition 5). In a case of the stamp condition 5, since the stamp corresponding to the lowest result in the ejection curve amount of the nozzle in the paper sheet P of the inspection object is imprinted, an operator can confirm the extent of the streak having the lowest visibility based upon the color of the stamp in the paper sheet P of the inspection object. As a result, an operator can perform a strict inspection on the streak having a relatively low visibility.

As described above, an operator can select whether to change the threshold of the determination for each color, and the stamp condition in a case of changing the threshold of the determination for each color.

Hereinafter, the method for attaching the stamp will be specifically described. In a case where there is present only one nozzle in which the curve is detected (defect nozzle and nozzle for correction object), a stamp corresponding to the ejection curve amount of the nozzle is imprinted. That is, in a case where the ejection curve amount of the i-th nozzle of K is 20 μm (low), the stamp A is imprinted, in a case where the ejection curve amount of the j-th nozzle of C is 15 μm (middle), the stamp B is imprinted, and in a case where the ejection curve amount of the k-th nozzle of Y is 16 μm (high), the stamp C is imprinted.

In the stamp condition 3, in a case where there are a plurality of nozzles in which the curve is detected, all the stamps corresponding to the ejection curve amounts of the respective defect nozzles are imprinted. In this case, in a case where the ejection curve amount of the i-th nozzle of K is 20 μm (low), in a case where the ejection curve amount of the j-th nozzle of K is 15 μm (middle) and in a case where the ejection curve amount of the k-th nozzle of K is 10 μm (high), the stamps A, B and C are imprinted. In a case where the ejection curve amount of the i-th nozzle of K is 20 μm (low) and in a case where the ejection curve amount of the j-th nozzle of C is 15 μm (middle), the stamps A and B are imprinted. In a case where the ejection curve amount of the i-th nozzle of K is 20 μm (low), in a case where the ejection curve amount of the j-th nozzle of C is 15 μm (middle) and in a case where the ejection curve amount of the k-th nozzle of Y is 16 μm (high), the stamps A, B and C are imprinted.

In the stamp condition 4, in a case where there are a plurality of nozzles in which the curve is detected, only the stamp corresponding to the lowest determination level in the detection threshold is imprinted. In this case, in a case where the ejection curve amount of the i-th nozzle of K is 20 μm (low), in a case where the ejection curve amount of the j-th nozzle of K is 15 μm (middle) and in a case where the ejection curve amount of the k-th nozzle of K is 10 μm (high), the stamp A is imprinted. In a case where the ejection curve amount of the i-th nozzle of K is 20 μm (low) and in a case where the ejection curve amount of the j-th nozzle of C is 15 μm (middle), the stamp A is imprinted. In a case where the ejection curve amount of the i-th nozzle of K is 20 μm (low), in a case where the ejection curve amount of the j-th nozzle of C is 15 μm (middle) and in a case where the ejection curve amount of the k-th nozzle of Y is 16 μm (high), the stamp A is imprinted.

In the stamp condition 5, in a case where there are a plurality of nozzles in which the curve is detected, only the stamp corresponding to the highest determination level in the detection threshold is imprinted. In this case, in a case where the ejection curve amount of the i-th nozzle of K is 20 μm (low), in a case where the ejection curve amount of the j-th nozzle of K is 15 μm (middle) and in a case where the ejection curve amount of the k-th nozzle of K is 10 μm (high), the stamp C is imprinted. In a case where the ejection curve amount of the i-th nozzle of K is 20 μm (low) and in a case where the ejection curve amount of the j-th nozzle of C is 15 μm (middle), the stamp B is imprinted. In a case where the ejection curve amount of the i-th nozzle of K is 20 μm (low), in a case where the ejection curve amount of the j-th nozzle of C is 15 μm (middle) and in a case where the ejection curve amount of the k-th nozzle of Y is 16 μm (high), the stamp C is imprinted.

As described above, the threshold of the determination is differentiated for each color and the stamp condition is changeable for each determination level, and therefore an operator can easily carry out the inspection according to the print content to the paper sheet P.

Figure 7:
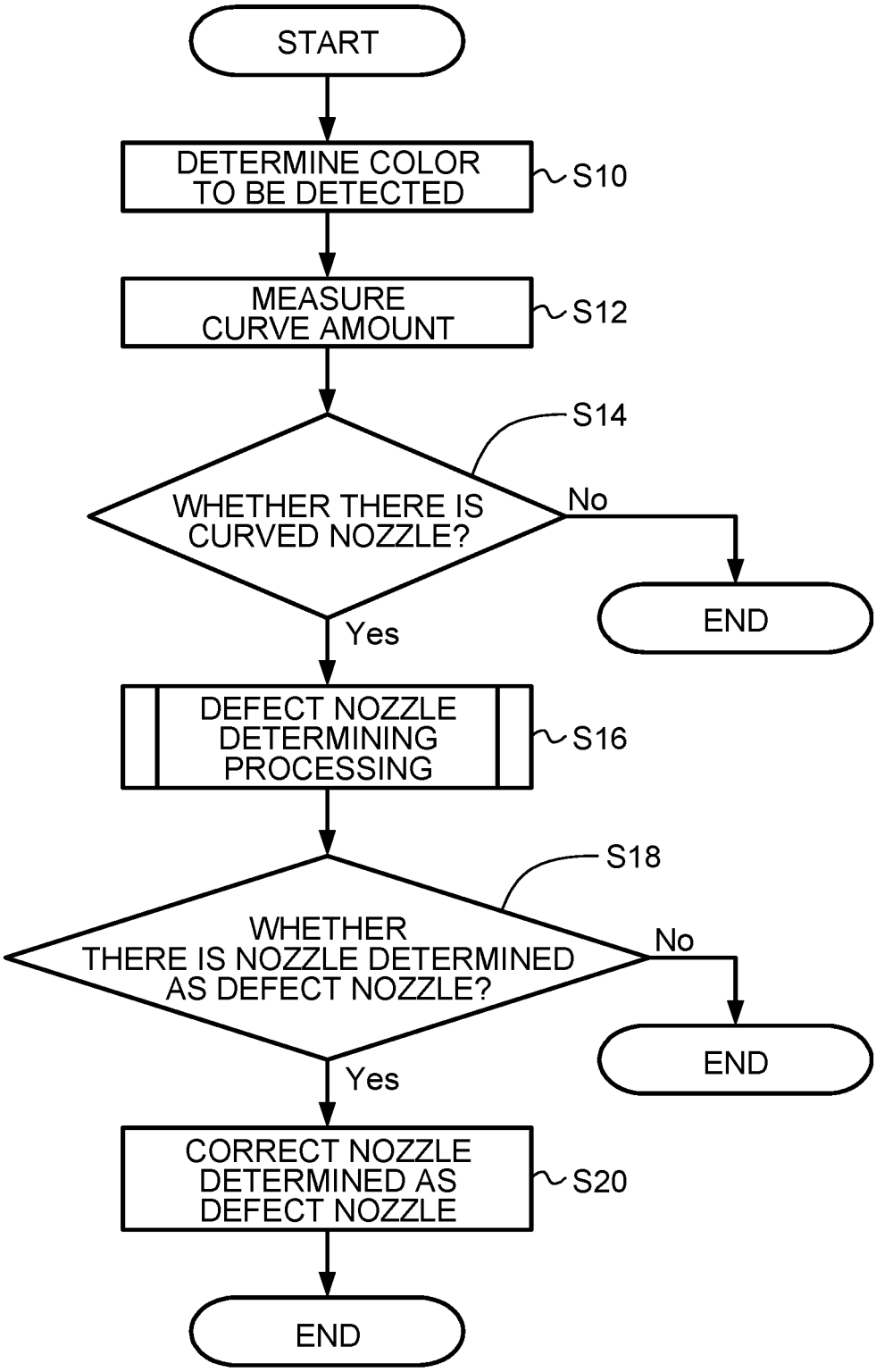
FIG. 7 is a flow chart illustrating defect nozzle determining processing according to an embodiment of the presently disclosed subject matter.

FIG. 7 is a flow chart illustrating a defect nozzle determining processing according to the embodiment of the presently disclosed subject matter. The processing in FIG. 7 is repeatedly executed to the paper sheets P of the inspection object one by one.

First, the image defect detecting part 136 obtains an image of the paper sheet P as the inspection object from the inline sensor 58 to make a determination of a color of an ink to be detected (ink color determining step: step S10).

Next, the image defect detecting part 136 uses a dot position measuring method described in Japanese Patent Application Laid-Open No. 2011-079257 (paragraphs [0092] and subsequent thereto) to measure an injection curve amount (an error of a dot position) of a nozzle (measuring step: step S12).

Next, in step S12, in a case where the curved nozzle is detected (Yes in step S14), the defect nozzle determining processing is executed (image defect detecting step: step S16). In step S16, for example, as illustrated in Table 1, three kinds of thresholds of "high", "middle" and "low" set for the respective colors are used to make a determination of the defect nozzle. In step S16, the image defect detecting part 136, for example, (1) in a case where the curve of a nozzle is detected twice in total in printing of one time, may determine the nozzle as a defect nozzle, or (2) in a case where the curve of a nozzle is successively detected twice, may determine the nozzle as non-ejection correction. The criterion for determination of the defect nozzle is not limited to the above (1) and (2). For example, an operator may increase/decrease the detection number of times of the curve in the above criterion.

Next, in a case where there is present the nozzle that is determined as a defect nozzle by the image defect detecting part 136 (Yes in step S18), the system controller 100 makes a correction of the nozzle determined as the defect nozzle (step S20). In step S20, for example, it is possible to apply a defect recording element correction step described in Japanese Patent Application Laid-Open No. 2011-161646.

The system controller 100 determines whether or not a stamp is imprinted on a paper sheet P and the kind and the number of stamps to be imprinted on a paper sheet P based upon the result of the determination in step S16 and makes stamp flag $F_{n,i,j}$ ON. The system controller 100 controls the stamp control part 208 and keeps on the imprinting of the stamp on the paper sheet P until the correction of the defect nozzle is completed.

The system controller 100 makes the stamp flag $F_{n,i,j}$ OFF in a case where the correction in step S20 is completed. Here, the stamp flag $F_{n,i,j}$ indicates whether or not correction of a nozzle of i color (i=C, M, Y, K) detected in the n-th paper sheet P ends. "j" is a parameter indicating the kind of a stamp imprinted for each ink color, for example, is set such that in a case of imprinting a stamp A of "low", j=1, in a case of imprinting a stamp B of "middle", j=2, and in a case of imprinting a stamp C of "high", j=3, in a case of imprinting stamps A and B of "low" and "middle", j=4 . . . .

Figure 8:
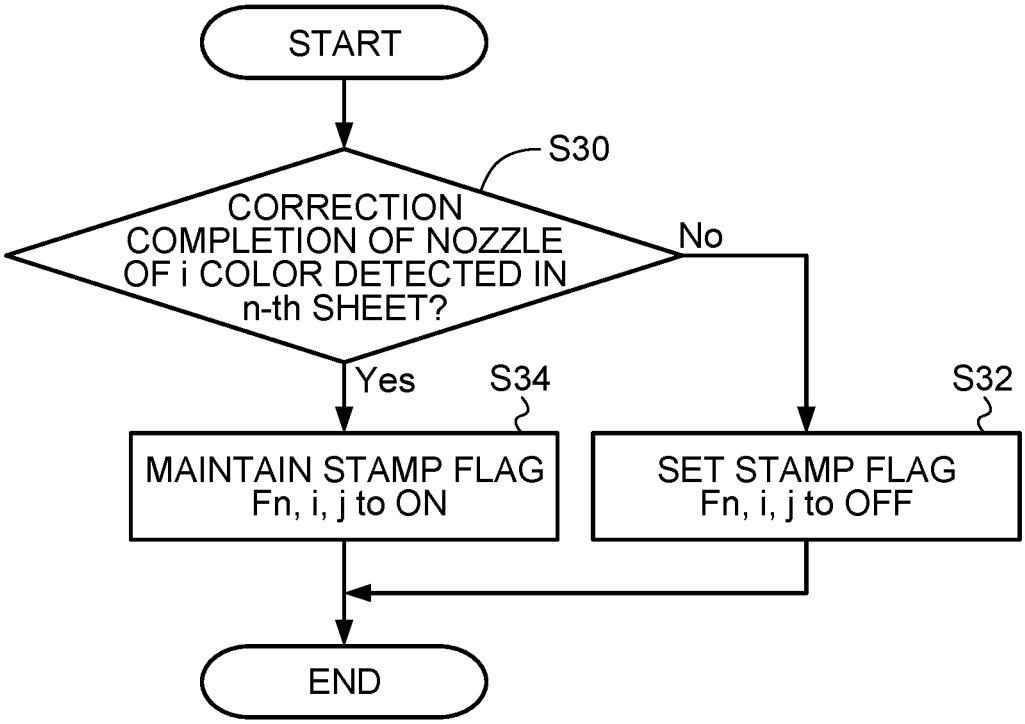
FIG. 8 is a flow chart illustrating monitoring processing of correction completion.

FIG. 8 is a flow chart illustrating monitoring processing of correction completion. As illustrated in FIG. 8, it is determined whether or not correction of a nozzle of i color (i=C, M, Y, K) detected in the n-th paper sheet P ends (step S30), and in a case of the correction completion, $F_{n,i,j}$ is set to OFF (step S32), and on the other hand, in a case of non-correction completion, $F_{n,i,j}$ is maintained to ON (step S34).

Figure 9:
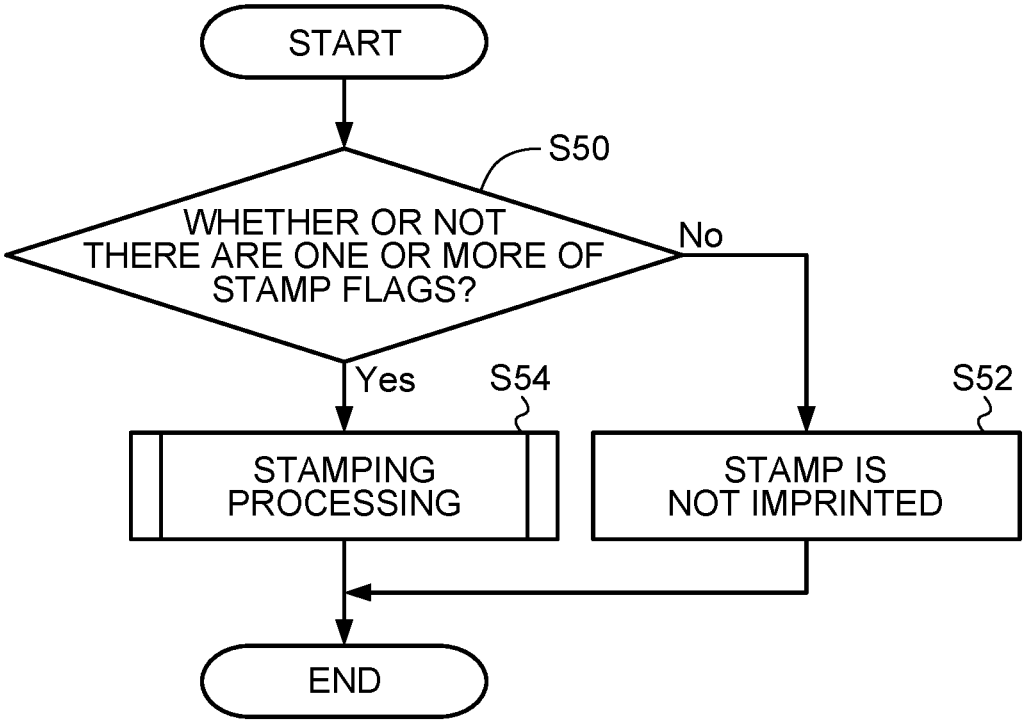
FIG. 9 is a flow chart illustrating stamp imprint determining processing.

FIG. 9 is a flow chart illustrating stamp imprint determining processing.

As described above, On and OFF are set to the stamp flag $F_{n,i,j}$ for each of the paper sheets P and for each of ink colors (i color (i=C, M, Y, K)). In a case where there are present one or more of $F_{n,i,j}$ set thus to ON (Yes in step S50), that is, in a case where there is present the nozzle where the correction is not completed, a stamp is imprinted on the paper sheet P according to a stamp condition set by an operator (stamp step: step S52). On the other hand, in a case where all the stamp flags are OFF (No in step S50), the imprint of the stamp is not carried out (step S54).

According to the present embodiment, in a case where the streak due to the nozzle is detected, the kind of the stamp can be changed according to the extent of the streak. Therefore since an operator can recognize the extent of the streak from the stamp, it is possible to support the inspection work by the operator and realize efficiency of the inspection work.

Further, according to the present embodiment, it is possible to change the threshold used for the determination of the defect nozzle (streak) according to the visibility for each of the colors of the inks and set the stamp condition in a case of a plurality of the defect nozzles. Thereby an operator can set the attachment method of the stamp according to use of the print sheet, the required accuracy and the like, and can facilitate the inspection work.

[Another Embodiment of Stamp Imprinting Processing]

Next, another embodiment of stamp imprinting processing will be explained with reference to FIG. 10 and FIG. 11. Components identical or similar to those in the above embodiment are referred to as identical reference signs to omit the explanation.

The inkjet recording apparatus 10 according to the present embodiment includes the stamping devices (stamping devices 202$A_k$, 202$B_k$ and 202$C_k$ for K, stamping devices 202$A_c$, 202$B_c$, and 202$C_c$, for C, stamping devices 202$A_m$, 202$B_m$, and 202$C_m$ for M and stamping devices 202$A_y$, 202$B_y$ and 202$C_y$ for Y), wherein three stamps can be imprinted for each color (CMYK). The colors of the stamps A, B and C imprinted by the stamping devices for the respective colors differ mutually for each kind, but in regard to each color of CMYK, the colors of the stamps A, B and C of the same kind may be respectively the same.

Figure 10:
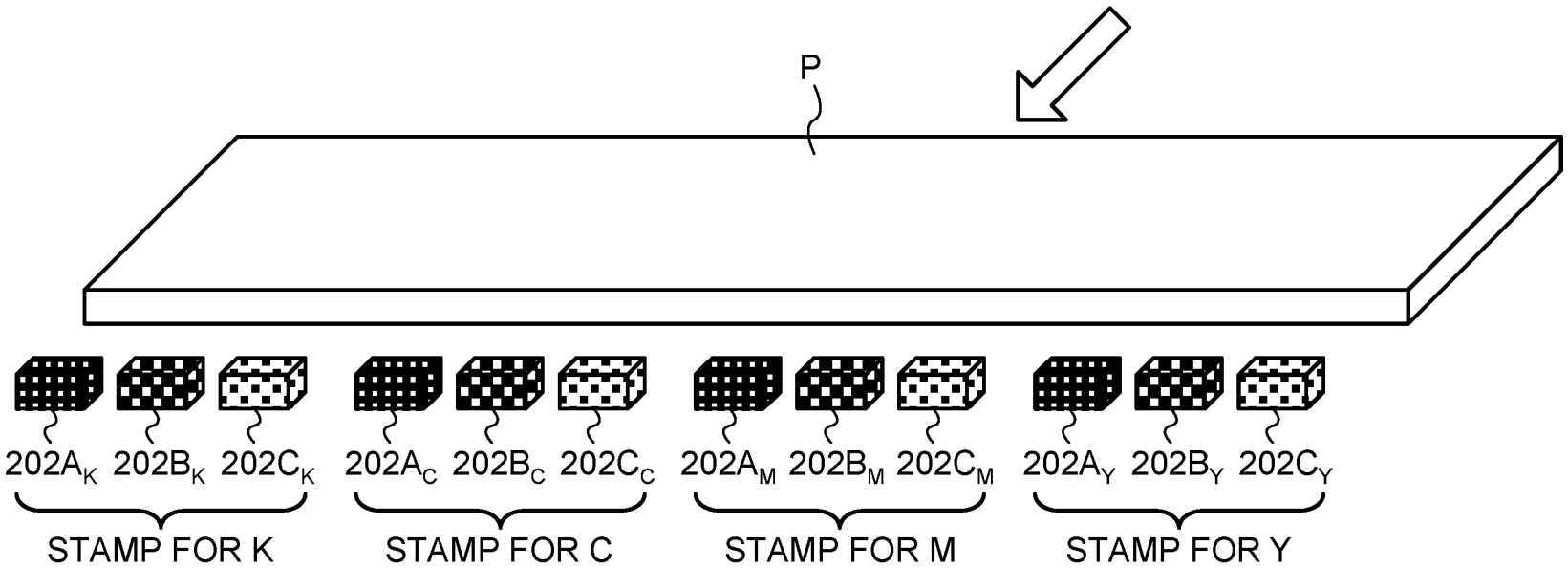
FIG. 10 is a perspective view schematically illustrating a stamping device according to another embodiment of the presently disclosed subject matter and a print sheet.
Figure 11:
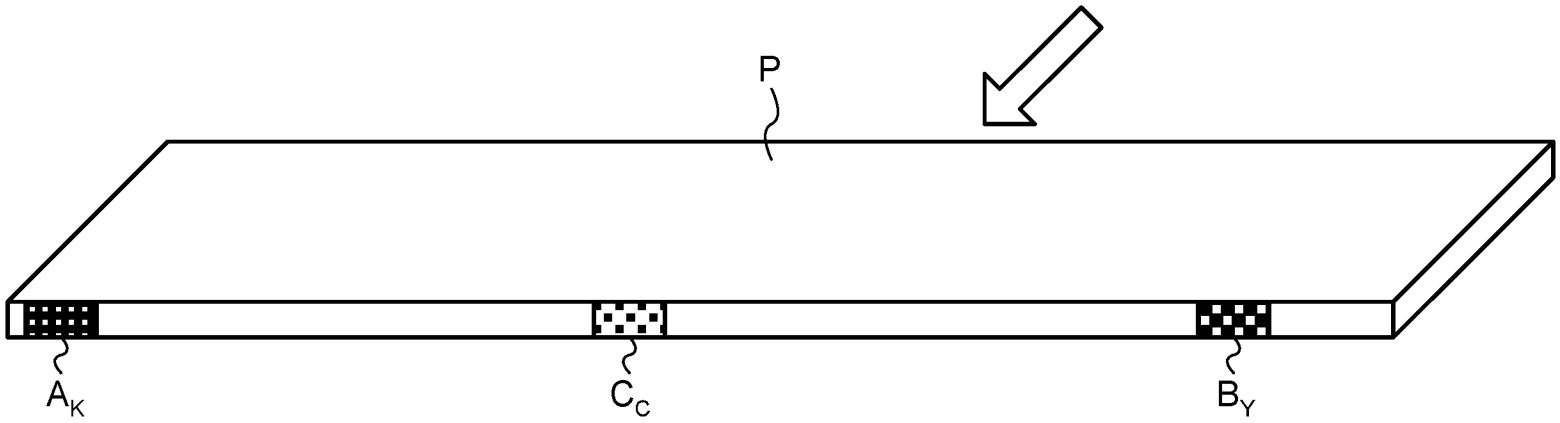
FIG. 11 is a perspective view illustrating an example where stamps are imprinted on the print sheet.

FIG. 10 is a perspective view schematically illustrating stamping devices according to another embodiment of the presently disclosed subject matter and a print sheet, and FIG. 11 is a perspective view illustrating an example where stamps are imprinted on the paper sheet. Arrows in FIG. 10 and FIG. 11 indicate the direction of a paper sheet P.

In a case where there is present only one nozzle in which the curve is detected (defect nozzle and nozzle for correction object), a stamp corresponding to the ejection curve amount of the nozzle is imprinted. That is, in a case where the ejection curve amount of the i-th nozzle of K is 20 μm (low), the stamp A for K is imprinted by the stamping device 202$A_k$ for K. In a case where the ejection curve amount of the j-th nozzle of C is 15 μm (middle), the stamp B for C is imprinted by the stamping device 202$B_c$ for C. In a case where the ejection curve amount of the k-th nozzle of Y is 16 μM (high), the stamp C for Y is imprinted by the stamping device 202$C_y$ for Y.

In the stamp condition 3, in a case where there are a plurality of nozzles in which the curve is detected, all the stamps corresponding to the ejection curve amounts of the respective defect nozzles are imprinted. In this case, in a case where the ejection curve amount of the i-th nozzle of K is 20 pin (high), in a case where the ejection curve amount of the j-th nozzle of K is 15 μm (middle) and in a case where the ejection curve amount of the k-th nozzle of K is 10 μm (low), the stamps A, B and C for K are respectively imprinted by the stamping devices 202$A_k$, 202$B_k$ and 202$C_k$ for K. In a case where the ejection curve amount of the i-th nozzle of K is 20 μm (high), in a case where the ejection curve amount of the j-th nozzle of C is 15 μm (middle), and in a case where the ejection curve amount of the k-th nozzle of C is 11 μM (low), the stamp A for K, the stamp B for C and the stamp C for C are imprinted. In a case where the ejection curve amount of the i-th nozzle of K is 20 μm (high), in a case where the ejection curve amount of the j-th nozzle of C is 15 μm (middle) and in a case where the ejection curve amount of the k-th nozzle of Y is 16 μm (low), the stamp A for K, the stamp B for C and the stamp C for Y are imprinted.

In the stamp condition 4, in a case where there are a plurality of nozzles in which the curve is detected, only the stamp corresponding to the lowest determination level in the detection threshold is imprinted. In this case, in a case where the ejection curve amount of the i-th nozzle of K is 20 μm (high), in a case where the ejection curve amount of the j-th nozzle of K is 15 μm (middle) and in a case where the ejection curve amount of the k-th nozzle of K is 10 μm (low), only the stamp A for K is imprinted. In a case where the ejection curve amount of the i-th nozzle of K is 20 μm (high), in a case where the ejection curve amount of the j-th nozzle of C is 15 μm (middle) and in a case where the ejection curve amount of the k-th nozzle of C is 15 μm (middle), the stamp A for K and the stamp B for C are imprinted. In a case where the ejection curve amount of the i-th nozzle of K is 20 μm (low), in a case where the ejection curve amount of the j-th nozzle of K is 15 μm (middle), in a case where the ejection curve amount of the j-th nozzle of C is 15 μm (middle) and in a case where the ejection curve amount of the k-th nozzle of Y is 16 μm (high), the stamp A for K, the stamp B for C and the stamp C for Y are imprinted.

In the stamp condition 5, in a case where there are a plurality of nozzles in which the curve is detected, only the stamp corresponding to the highest determination level in the detection threshold is imprinted. In this case, in a case where the ejection curve amount of the i-th nozzle of K is 20 μm (high), in a case where the ejection curve amount of the j-th nozzle of K is 15 μm (middle) and in a case where the ejection curve amount of the k-th nozzle of K is 10 μm (low), only the stamp C for K is imprinted. In a case where the ejection curve amount of the i-th nozzle of K is 20 μm (high), in a case where the ejection curve amount of the j-th nozzle of C is 15 μm (middle) and in a case where the ejection curve amount of the k-th nozzle of C is 15 μm (middle), the stamp B for K and the stamp B for C are imprinted. In a case where the ejection curve amount of the i-th nozzle of K is 20 μm (low), in a case where the ejection curve amount of the j-th nozzle of K is 15 μm (middle), in a case where the ejection curve amount of the j-th nozzle of C is 15 μm (middle) and in a case where the ejection curve amount of the k-th nozzle of Y is 16 μm (high), the stamp B for K, the stamp B for C and the stamp C for Y are imprinted.

In addition, in a case where there are a plurality of nozzles in which the curve is detected, it is possible to imprint only the stamp corresponding to the lowest determination level in the detection threshold, for each color (stamp condition 6). In this case, in a case where the ejection curve amount of the i-th nozzle of K is 20 μm (high), in a case where the ejection curve amount of the j-th nozzle of K is 15 μm (middle) and in a case where the ejection curve amount of the k-th nozzle of K is 10 (low), the stamp A for K is imprinted. In a case where the ejection curve amount of the i-th nozzle of K is 20 μm (high), in a case where the ejection curve amount of the j-th nozzle of C is 15 μm (middle) and in a case where the ejection curve amount of the k-th nozzle of C is 15 μm (middle), the stamp A for K and the stamp B for C are imprinted. In a case where the ejection curve amount of the i-th nozzle of K is 20 μm (low), in a case where the ejection curve amount of the j-th nozzle of K is 15 μm (middle), in a case where the ejection curve amount of the j-th nozzle of C is 15 μm (middle) and in a case where the ejection curve amount of the k-th nozzle of Y is 16 μm (high), the stamp A for K, the stamp B for C and the stamp C for Y are imprinted.

In the present embodiment, the paper sheet P may be discharged to a different place according to a magnitude of the ejection curve amount of the nozzle. For example, the sheet discharging part may include a plurality of sheet discharging parts, and in the sheet discharging part a position where the paper sheet P is discharged may differ in a direction perpendicular to the conveyance direction of the paper sheet P, for example, the paper sheet P may be discharged in order of "high", "middle", "low" and "OFF".

The presently disclosed subject matter can be realized as a program (control program in the printing apparatus) that causes the computer to execute the above processing, or as a non-temporary recording medium or program product storing such program. By applying such program to the computer, it is possible to cause the calculation device and the like of the computer to work as the image defect detecting function and the stamping function.

What is claimed is:

1. A printing apparatus comprising:

an image recording part including an inkjet head that ejects inks from a plurality of nozzles to record an image on a surface of a recordable medium;

an image defect detecting part that detects an ejection curve amount of a nozzle in the inkjet head and an image defect from the recordable medium on the surface of which the image is recorded;

a stamping device that attaches a stamp indicating presence of the image defect on the recordable medium in a case where the image defect is detected; and a stamp control part that differentiates an attachment form of the stamp by the stamping device in accordance with a magnitude of the ejection curve amount of the nozzle.

2. The printing apparatus according to claim 1, wherein the image defect detecting part detects the image defect for each of colors of inks and differentiates a threshold of the ejection curve amount of the nozzle to be detected as the image defect.

3. The printing apparatus according to claim 1, wherein the inkjet head ejects at least a black ink, and the image defect detecting part performs detection of the image defect for each of colors of the inks and performs detection of the image defect by the black ink prior to detection of the image defect by an ink of a color other than black.

4. The printing apparatus according to claim 3, wherein the inkjet head further ejects a yellow ink, and the image defect detecting part makes a threshold of an ejection curve amount of the nozzle to be used for detection of the image defect in regard to the yellow ink larger than a threshold of an ejection curve amount of the nozzle to be used for detection of the image defect in regard to an ink of a color other than yellow.

5. The printing apparatus according to claim 1, wherein the inkjet head ejects at least a black ink, and the image defect detecting part performs detection of the image defect for each of colors of the inks and makes a threshold of an ejection curve amount of the nozzle to be used for detection of the image defect in regard to the black ink smaller than a threshold of an ejection curve amount of the nozzle to be used for detection of the image defect in regard to an ink of a color other than black.

6. The printing apparatus according to claim 1, wherein the stamp control part differentiates at least one of colors, numbers and positions of the stamp attached by the stamping device in accordance with the ejection curve amount of the nozzle.

7. The printing apparatus according to claim 6, wherein the stamping device comprises a plurality of stamping devices to attach a plurality of kinds of stamps differing in at least one of colors, numbers and positions of the stamp.

8. The printing apparatus according to claim 7, wherein the stamping device comprises a plurality of stamping devices to attach a plurality of kinds of stamps differing in accordance with the ejection curve amount of the nozzle for each of the colors of the inks of the inkjet head.

9. The printing apparatus according to claim 1, further comprising an operating part configured to set an attachment condition of the stamp upon reception of operating input of an operator.

10. The printing apparatus according to claim 1, wherein the recordable medium is discharged to a different place in accordance with a magnitude of the ejection curve amount of the nozzle.

11. A control method for a printing apparatus comprising:

an image defect detecting step of detecting an ejection curve amount of a nozzle in an inkjet head and an image defect from a recordable medium on a surface of which an image is recorded by an image recording part provided with the inkjet head having a plurality of nozzles, and a stamp step of attaching a stamp indicating presence of the image defect on the recordable medium by a stamping device in a case where the image defect is detected;

the stamp step differentiating an attachment form of the stamp by the stamping device in accordance with a magnitude of the ejection curve amount of the nozzle.

12. A non-transitory computer-readable recording medium including a control program for a printing apparatus stored thereon, such that when the program is read and executed by a computer, the computer is configured to achieve:

an image defect detecting function of detecting an ejection curve amount of a nozzle in an inkjet head and an image defect from a recordable medium on a surface of which an image is recorded by an image recording part provided with the inkjet head having a plurality of nozzles; and a stamp function of attaching a stamp indicating presence of the image defect on the recordable medium by a stamping device in a case where the image defect is detected, the stamp function differentiating an attachment form of the stamp by the stamping device in accordance with a magnitude of the ejection curve amount of the nozzle.

* * * * *